US008786113B2

(12) United States Patent
Tinnen et al.

(10) Patent No.: US 8,786,113 B2
(45) Date of Patent: Jul. 22, 2014

(54) DEVICE AND A METHOD FOR DOWNHOLE ENERGY GENERATION

(75) Inventors: Bård Martin Tinnen, Stavanger (NO); Håvar Sørtveit, Hommersåk (NO)

(73) Assignee: Well Technology AS (NO)

( * ) Notice: Subject to any disclaimer, the term of this patent is extended or adjusted under 35 U.S.C. 154(b) by 961 days.

(21) Appl. No.: 12/934,690

(22) PCT Filed: Mar. 27, 2009

(86) PCT No.: PCT/NO2009/000113

§ 371 (c)(1),
(2), (4) Date: Nov. 8, 2010

(87) PCT Pub. No.: WO2009/123466

PCT Pub. Date: Oct. 8, 2009

(65) Prior Publication Data

US 2011/0049901 A1 Mar. 3, 2011

(30) Foreign Application Priority Data

Apr. 2, 2008 (NO) ..... 20081634

(51) Int. Cl.
*E21B 41/00* (2006.01)

(52) U.S. Cl.
USPC ..... 290/1 R

(58) Field of Classification Search
CPC ..... E21B 41/00
USPC ..... 290/1 R
See application file for complete search history.

(56) References Cited

U.S. PATENT DOCUMENTS

| | | | | |
|---|---|---|---|---|
| 2,895,063 | A | 7/1959 | Morris | |
| 3,663,845 | A | 5/1972 | Apstein | |
| 4,387,318 | A * | 6/1983 | Kolm et al. | 310/330 |
| 4,464,939 | A * | 8/1984 | Corpron | 73/861.24 |
| 4,485,679 | A * | 12/1984 | Pitt et al. | 73/861.22 |
| 4,536,674 | A * | 8/1985 | Schmidt | 310/330 |
| 5,839,508 | A | 11/1998 | Tubel et al. | |
| 6,504,258 | B2 | 1/2003 | Schultz et al. | 290/1 |
| 7,199,480 | B2 | 4/2007 | Fripp et al. | 290/1 |

(Continued)

FOREIGN PATENT DOCUMENTS

| | | | |
|---|---|---|---|
| JP | 2006132397 | A * | 5/2006 |
| JP | 2006226221 | A * | 8/2006 |

(Continued)

OTHER PUBLICATIONS

Computer translation of JP 2006226221 A to Suzuki et al. of Aug. 31, 2006.*

(Continued)

*Primary Examiner* — Joseph Waks
(74) *Attorney, Agent, or Firm* — Ostrolenk Faber LLP

(57) ABSTRACT

A downhole electrical energy generating device and a method for transforming energy from a fluid flow passing the device are described. A vibrating assembly is influenced by the fluid flow to oscillate, the vibrating assembly including an elongated body having a longitudinal axis being arranged non-parallel with the fluid flow, a stiff body connecting the elongated body to a portion of the device located downstream of said elongated body; at least one energy harvester influenced by the vibrating assembly, wherein the energy generating device is provided with means for influencing the oscillation frequency of the vibrating assembly.

14 Claims, 22 Drawing Sheets

(56) References Cited

U.S. PATENT DOCUMENTS

| | | | | |
|---|---|---|---|---|
| 7,224,077 | B2 | 5/2007 | Allen | 290/1 |
| 8,047,232 | B2 * | 11/2011 | Bernitsas et al. | 137/808 |
| 2005/0230973 | A1 | 10/2005 | Fripp et al. | |
| 2005/0230974 | A1 * | 10/2005 | Masters et al. | 290/1 R |
| 2006/0064972 | A1 | 3/2006 | Allen et al. | |
| 2007/0007770 | A1 * | 1/2007 | Jager et al. | 290/1 R |
| 2007/0176430 | A1 * | 8/2007 | Hammig | 290/54 |
| 2007/0210580 | A1 * | 9/2007 | Roberts et al. | 290/1 R |
| 2008/0048455 | A1 * | 2/2008 | Carney | 290/54 |
| 2008/0277941 | A1 * | 11/2008 | Bowles et al. | 290/54 |

FOREIGN PATENT DOCUMENTS

| | | | |
|---|---|---|---|
| WO | WO 01/55551 | A | 8/2001 |
| WO | WO 02/057589 | A2 | 7/2002 |
| WO | WO 2007/071975 | A | 6/2007 |

OTHER PUBLICATIONS

International Search Report dated Jul. 15, 2009, issued in corresponding international application No. PCT/N02009/000113.

Norwegian Search Report dated Oct. 8, 2008 issued in corresponding Norwegian Patent Application No. 20081634.

* cited by examiner

DEVICE AND A METHOD FOR DOWNHOLE ENERGY GENERATION

CROSS REFERENCE TO RELATED APPLICATIONS

The present application is a 35 U.S.C. §371 National Phase conversion of PCT/NO2009/000113, filed Mar. 27, 2009, which claims benefit of Norwegian Application No. 20081634, filed Apr. 2, 2008, the disclosure of which is incorporated herein by reference. The PCT International Application was published in the English language.

This invention regards a system and a method related to local energy generation for downhole tools and devices used in association with wells for the production of hydrocarbons.

BACKGROUND

Wells for the production of hydrocarbons are designed in a range of different ways, depending on many influencing factors. Such factors include production characteristics, safety, well servicing, installation- and re-completion issues, downhole monitoring and control requirements and compartmentalisation of producing zones.

Further, as wells mature, they are normally serviced using techniques known as per se on regular intervals.

Intervention services such as wireline and coil tubing are most commonly applied. The service could, as an example, be conducted for data acquisition purposes, for zone isolation or opening for production from new zones, for zone stimulation, for removal of salt deposits or to fix leakages in the wells tubular.

Common well components such as plugs and packers for isolation purposes, valves such as flow control valves or choke valves, data acquisition devices such as pressure-, temperature, flow rate and flow composition meters may be utilised in conjunction with a well, either as a part of the well completion (incorporated as part of the well's tubular) or as intervention tools (intervened in the well and in some cases left in the well, permanently or on a long term basis, attached to the well tubular using techniques as known per se).

The installation of the production tubular, including a selection of the above described components, and the wellhead is referred to as completing the well. Many of the above described devices can be installed as an integrated part of the well completion (tubular). In many cases, a selection of said devices can be remotely operated via control lines (hydraulic or electric lines). Such control lines can be hydraulic and/or electrical and/or fibre-optic lines that run all the way from the reservoir section(s) of a well to the surface.

Evolution of oil wells has entailed methods and well designs such as multi lateral wells and side-tracks and smart well completions. A multilateral well is a well with several "branches" in the form of drilled bores that origin from the main bore. The method enables a large reservoir area to be drained by means of one well. A side track well is typically an older production well that is used as the basis for drilling one/multiple new bores. Hence, only the bottom section of the new producing interval need to be drilled, hence time and costs are saved.

Smart well completions are typically applied in wells with several producing and/or injecting zones and/or wells with several bores (i.e. multilateral wells). Said smart well completions normally comprise a series of monitoring systems and/or valves incorporated as integrated parts of the production tubular, to monitor and control production from each producing interval in the well or injection into each injection interval in the well. Smart well monitoring systems and valves are normally operated remotely through hydraulic and/or electric communication (and in some cases partly fibre optic) lines that run all the way from the reservoir section(s) of a well to the surface. Often, as a backup solution, smart well valves can also be manipulated by an intervention operation (such as coiled tubing, wireline, or slickline), should the remote activation systems for some reason fail to operate. Smart well valves may comprise on/off valves (i.e. either fully open or fully shut) as well as variable opening chokes.

New well designs such as the ones described above have in a number of cases entailed a new challenge in the form of inaccessible areas of the well. In particular, this may apply for multilateral wells and sidetrack wells. It is normally deemed as non-desirable to perform interventions in the side branches of a well as the risk of getting stuck in the junction between branches and/or causing other types of damage to the well are perceived to be of too high a risk. Neither is it in most cases possible to bring control lines into branches of a well as per today. As a consequence, measurement and control tasks in branch wells are normally limited to areas where the branch enters the main bore of the well, and can normally not be executed within the branch(es) itself.

Another example of inaccessibility related to well segments is subsea wells, where the wellheads are located on the seabed. Here, interventions such as data acquisition or barrier installation jobs are scarce due to low availability and high costs associated with required drilling rigs or intervention vessels that need to be mobilised for the work.

In addition to the problem with non-accessible wells and/or areas in wells, several other factors may inflict challenges to the operation of well equipment. Such factors include debris/fill material, corrosion, scaling (salt deposits), and damage to control lines and line connectors. As an example, debris such as sand, scale (salt deposit) particles or steel fragments from drilling or perforation operations may deposit on top of intervention plugs, making it very difficult to retrieve them after usage. Scale and corrosion on a plug itself may cause similar problems.

In summary, there is a range of possible scenarios that entail non-accessibility to or non-operability of downhole tooling required for important work in wells related to oil and gas production.

To solve the said problems related to accessibility and/or operation of the above described well components new, autonomous systems and methods related to plugs, packers, valves and monitoring systems are emerging. Further, said autonomous system commonly uses wireless communication methods for communication with control systems located at the surface of the earth or at communication nodes located elsewhere in or on the wells.

Several systems are evolving that enable wireless communication in wells related to the production of hydrocarbons. One such wireless system and method is explained in detail in patent applications NO 20044338 and NO 20044339, owned by the applicant of this patent application. Further, patent application NO 20061275, also owned by the applicant of this patent application describes an alternative wireless communication technique and related applications.

A limitation with autonomous and/or wireless based downhole application is the provision of power for system operation; as all autonomous devices are dependant on local supply of power to be operated in a proper manner.

The present invention relates generally to local, downhole electrical power generation and, in a preferred embodiment describes herein, more particularly to a power generator based on flow-induced vibration principles.

Existing Methods

In order to energize downhole wireless telemetry systems and autonomous devices it is commonly accepted to utilize non-rechargeable batteries. However, such batteries entail several challenges which limit the possible use of wireless telemetry and autonomous devices:

- Non-rechargeable batteries suffer from a phenomenon referred to as "self-discharge". Self-discharge is a natural phenomenon of a chemical system, defined as the electrical capacity that is lost when the cell simply sits on the shelf. Self-discharge is caused by electrochemical processes within the cell. At a higher temperature or with advanced age, the self-discharge rate increases substantially. Typically, the rate of self-discharge doubles with every 10° C. Even at quite common well temperature surroundings, non-rechargeable batteries can suffer from self discharge as high as >0.3% per day. The higher the downhole temperature, the lower is the lifetime, typically speaking about months in a High Pressure/High Temperature (HPHT) environment. Hence, due to the subject of self-discharge, it is a challenge to make optimum usage of the energy potential that non-rechargeable batteries represent.
- Non-rechargeable batteries will in many cases provide insufficient amounts of energy required for multiple and/or high power requiring operations of a downhole device such as a valve. This entails that an autonomous system powered by a non-rechargeable battery cannot be utilized in smart well arrangements.
- Wireless telemetry systems and autonomous devices powered by non-rechargeable batteries are dependent on frequent intervention to replace batteries as they are depleted for energy. This will in many cases make wireless/autonomous downhole technology undesired.

Based on challenges described above it can be concluded that wireless telemetry systems and autonomous devices are dependant on local downhole power generation for prolonged operation as well as high temperature applications. Several methods have been patented in the industry and some are developed. However, known existing systems suffer from certain drawbacks resulting in short lifetime and/or too low energy generation levels, and may not be applicable for many autonomous systems. A selection of methods can be exemplified as follows:

- Intrusive Propellers/turbines. Such approaches can provide high levels of energy generation, but are vulnerable in hydrocarbon well environments due to factors such as bearing wear, particles plugging bearings, particle wear and/or cavitations of propeller blades, and as a result it is undesired to utilize such technology for long term applications with downhole autonomous systems.
- Temperature—Peltier elements. Such elements generate energy based on temperature difference between two points. The technology is not applicable in a well environment as the temperature is near constant over short distances.
- Nuclear generators have a good energy potential, but also a grave pollution and risk potential.
- Annulus pressure pulse generators are systems where a pump located on the surface of the earth is used to impose pressure surges in the annular space between the production tubular and the casing of the well. A downhole accumulator, located in the same annulus but in the reservoir end of the completion, is compressed at high pressure peaks and expands at low pressure peaks. This movement can directly or indirectly, by means of a flowing fluid, be used to operate a downhole turbine generator. Annulus pulse generators require that the well completion is tailored for such generation, and is therefore a poor match to retrofit systems (i.e. systems that are installed by a well servicing technique subsequent to the well completion process). Further, such generators would impact on barrier requirements, and would not be applicable in high pressurised wells because the required downhole accumulator would provide a too small mechanical working window.

Upon careful consideration, the applicant of this patent has concluded that vibration based energy generation systems are perceived to be the best option for a long-term application in a hydrocarbon well environment.

Vibration, or more precisely flow-induced vibration generators, have been investigated and patented by the industry. Patents written as far back as 1959 (U.S. Pat. No. 2,895,063) and 1971 (U.S. Pat. No. 3,663,845) describes means of generating electric power from a flowing fluid (in this case air) which causes an object designed for the purpose to vibrate, said object being connected to a energy generating device such as a magnet and coil assembly.

As a further example, the present invention has similarities to U.S. Pat. Nos. 5,839,508 and 7,199,480. However, all the above mentioned patent documents as well as other investigated publications that describe the state of such technology are perceived to have weaknesses with respect to application in a hostile and highly pressurised downhole environment as well as gaining an optimal output of electric energy.

The latter—i.e. output of electric energy in an oil well by means of a vibration assembly—has proven, through research, to be a challenging task. As an example, power output in the order of magnitude W (Watt) may be relatively hard to achieve (output in the order of mW is more likely to expect), hence it is of great importance that downhole energy generation devices are designed for as high efficiency as possible. This may not be achievable without novel, inventive design features related to vibrating based energy generation tooling as described herein.

Based on the existing knowledge from public information, such as the likes of U.S. Pat. Nos. 2,895,063 and 3,663,845, the current invention identifies novel and inventive features required for high-pressure regime, downhole operations where the output of power needs to be optimised.

THE OBJECT OF THE INVENTION

The objective of the invention is to provide a novel vibration based energy generation system to add lifetime, functionality and redundancy to the operation of autonomous downhole devices.

Said autonomous downhole devices could have the function to undertake wireless communication to/from external wireless communication nodes (placed in the same well or at the surface of the earth), and perform execution of required work operations. Such work operations could be performed on associated system elements such as packers, plugs, valves, monitoring systems, and wireless telemetry systems.

An entailing objective of the invention is to provide for autonomous, preferably stand-alone downhole solutions in relation to plugs, packers, valves, monitoring systems, and wireless telemetry systems associated with wells for the production of hydrocarbons, that overcome the problems identified above, such as problems with installing and operating equipment in non-accessible areas of wells and non-accessible/malfunctioning equipment due to factors such as debris, sand, scale and corrosion.

THE INVENTION

In a first aspect of the present invention there is provided a downhole electrical energy generating device for transforming energy from a fluid flow passing the device, comprising:

at least one vibrating assembly influenced by the fluid flow to oscillate, the vibrating assembly including an elongated body having a longitudinal axis being arranged non-parallel with the fluid flow, a stiff body connecting the elongated body to a portion of the device located downstream of said elongated body;

at least one energy harvester influenced by the vibrating assembly, wherein the energy generating device is provided with means for influencing the oscillation frequency of the vibrating assembly.

In one embodiment, the invention comprises a downhole energy generation device consisting of a vibrating assembly, an atmospheric or pressure compensated compartment containing energy harvester(s) (vibration-to-electric energy converter such as a magnet/coil assembly), an active tuning device, and an electronics module connected to a rechargeable battery pack.

Further to a preferred embodiment, the vibrating assembly includes a stiff body in the form of a rod, and an elongated body also denoted "crossbar" in the following. The rod is required to connect the crossbar to the active tuning device and the pressure compensated compartment containing the energy harvester.

The crossbar is of a specific shape and geometry as required to induce an optimised vortex shedding effect as fluid flow passes the vibrating assembly. In this preferred embodiment, well fluids will flow onto and around the crossbar, and a turbulent regime, known as vortex shedding ("Von-Karman" vortices), is created along and/or downstream of the crossbar. Vortex shedding and Von-Karman vortices are well known as per se, and are associated with relatively predictable and stable oscillations (alternating pressure differential).

In another preferred embodiment, an appropriate shape and geometry of the crossbar, combined with an added feature to suppress undesired turbulence generation in certain planes, will entail that the sought, optimised Von Karman vortices will be created in a desired two dimensional plane with respect to the vibrating assembly. Hence the crossbar will be subjected to optimal alternating lift forces in said two dimensional planes and the main portion of the crossbar oscillations occurs along one axis only. In a preferred embodiment, the system device of this application comprises elements for mechanically preventing the crossbar and the vibration assembly from oscillating in any planes but the desired plane, along the desired axis.

Further, in a preferred embodiment, the added features to suppress undesired turbulence, referred to as a z-axial turbulence suppressor herein, is in the form of one or more shields attached to one or more portions of the crossbar, preferably at the end surfaces (with respect to the z-axis) of the crossbar. The purpose of the z-axial turbulence suppressor is to prevent the generation of undesired vortices in the downstream wake of the crossbar, vortices that are mostly perpendicular to the desired axis of vibration and that carry the potential to alter (reduce) the desired Von Karman vortices in the desired plane, along the desired axis, as demonstrated through recent research by the applicant of this patent.

In a preferred embodiment, an active tuning module enables the system device of this invention to change/correct the natural oscillating, frequency of the oscillating system components (vibration assembly). As an example, this could be required if changes in flow rates or flow composition entail changes in the imposed Von Karman vortexes, i.e. the fluid imposed vibration frequency. By operating the tubing module, the natural oscillating frequency of the vibration assembly could be changed to match the fluid imposed vibrations. Hereby, resonance and thereby an optimal energy harvesting process could be obtained.

In one embodiment, the active tuning module comprises one or more sensor devices for the registration of (negative) changes in system performance, such as reduced energy levels measured by means such as accelerometers readings or energy harvester output. Further, upon indication of said changes, the system possesses capabilities to change the natural oscillating frequency of the vibration assembly. In one embodiment, the active tuning module comprises an actuator operating a spring, such as a progressive spring, to change the stiffness/spring constant of the vibrating assembly, hence the natural oscillating frequency. In another embodiment, the active tuning module comprises a mass-transfer system/function in order to change the oscillating mass of the vibration system, hence the natural oscillating frequency. In one embodiment, the frequency tuning is controlled by a preprogrammed routine, based on simulations related to the given well/hardware configuration. In another embodiment, the frequency tuning is achieved by performing one/more sweeps, for instance by compressing a progressive spring from one predetermined set value to another set value, while monitoring at which compression displacement the energy output, alternatively accelerometer output is at maximum.

In one embodiment of the invention, the active tuning module is fully or partly located in a pressure compensated area of the device.

In a preferred embodiment the pressure compensated area of the device is gas filled, and the interface between the vibrating assembly and the pressure compensated area of the device is a metal process bellows. By means, a gas filled environment would impose far less damping on an oscillating magnet/coil assembly than a liquid filled environment. Further, a flexible metal bellows interface would also provide for a mechanically very flexible connection between the well regime where the vibrating assembly is located and the pressure compensated, gas filled compartment where the energy harvester is located. Again, this would contribute to optimise the theoretical energy output.

Further, for a gas filled compensated compartment, in a preferred embodiment, such compartment would be associated with a progressive/gradual gas pressure compensating system sourcing gas from an in-built high-pressure gas compartment while intervening the tooling in the well. In that manner, the flexible process bellows described above will not suffer from mechanical damage neither during installation or downhole use. An associated bleed-off system would allow also for a safe retrieval of the system out of the well.

In another preferred embodiment, parts or the whole of the energy harvester module is mounted inside the crossbar of the vibrating assembly.

In one preferred embodiment of the invention, the magnets of an energy harvester are kept static while the coils are part of the vibrating assembly. In that manner, the natural frequency of the vibration system can be reduced (as the coil is lighter than the magnet), which in many cases is beneficial with respect to tuning of fluid imposed vibration and the natural oscillating frequency of the vibrating assembly.

The rechargeable battery pack may comprise any type rechargeable battery, and in a preferred embodiment the rechargeable battery pack comprises high temperature rechargeable batteries.

In a second aspect of the present invention there is provided a method for optimising energy harvesting from a fluid flowing in a pipe, the method comprises the steps of arranging a downhole electrical energy generating device in the fluid flow, said device comprising at least one vibrating assembly influenced by the fluid flow, and at least one energy harvester influenced by the vibrating assembly, wherein the method further comprising providing the device with means for influencing the oscillation frequency of the vibrating assembly.

Typical Application and Operation

Common applications would be the operation of packers, plugs, valves, monitoring systems. In general, all downhole components requiring mechanical operation and/or communication, in particular downhole components that for some reason is or has become non-accessible for intervention tool strings or permanent communication/power lines, could be subject of the invention.

REFERENCE TO FIGURES

In what follows, there is described an example of preferred embodiments which are visualized in the accompanying drawings, in which:

FIG. 1 provides a general, modular sketch of a downhole tooling comprising an energy generator function installed in a well.

The well 101 is described herein as being a producing well in which fluid is produced from a reservoir formation 106 into a tubular string 108, and is then flowed through this tubular string 108 to surface. However, it is to be clearly understood that the principles of the present invention may be incorporated into other types of wells and other systems, for example, where fluid is injected into a formation or circulated in the well (such as drilling operations), where fluids pass from a relatively high pressure source to a relatively low pressure source within the well, or where fluid flows from a pump or other "artificial" pressure source etc. Thus, it is not necessary in keeping with the principles of the present invention for fluids to be produced through a tubular string 108 or from a well 101.

Figure 1:
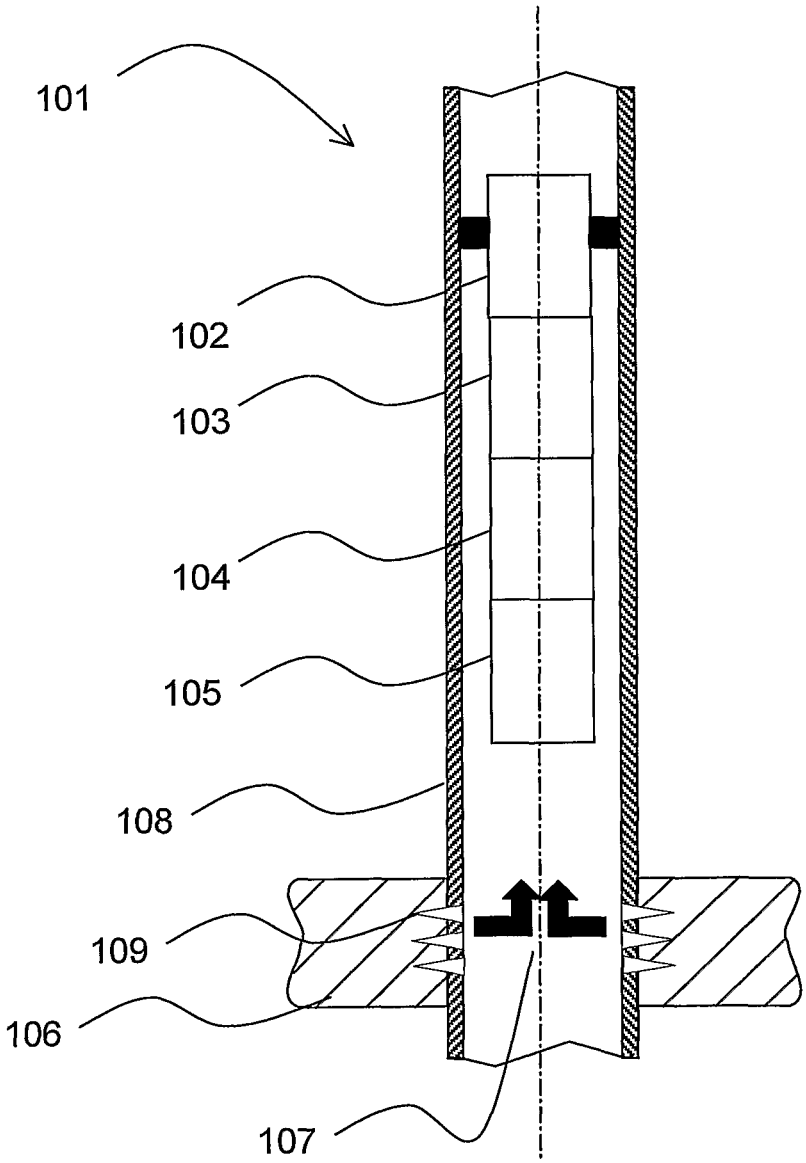
FIG. 1 illustrates an example of a subterranean well 101 which embodies principles of the present invention. It is to be understood that the various embodiments of the present invention described herein may be utilized in various orientations, such as inclined, inverted, horizontal, vertical, etc., and in various configurations, without departing from the principles of the present invention.

In the well 101 as depicted in FIG. 1, fluid from the form ation 106 enters the tubular string 108 through a flow access 109, which may be but is not limited to perforations and/or a valve, and flows upwardly in the tubular string 108, as represented by the arrows 107.

Further, FIG. 1 illustrates a preferred embodiment of the invention, where an energy generator system 105 is installed in the tubular string 108, in the proximity of the centre of the fluid flow 107. This fluid flow 107 causes the energy generator 105 to generate electrical power. In one embodiment the energy generator 105 is installed in conjunction with a gauge 104, such as a pressure gauge, and a telemetry system 103, which may be installed at any producing depth in well 101 utilizing a packer or plug system 102. However, it is to be clearly understood that the gauge 104 and the telemetry system 103 is used merely as an example of the wide variety of downhole tools and other types of devices that may be powered by the energy generator 105. Other devices such as valves, flow control devices, communication devices, etc., could form part of the application according to the invention, and furthermore the energy generator can be installed into a well utilizing other means than a packer or plug system 102, which in this embodiment is included as an example.

The various devices, such as the gauge 104 and the telemetry system 103 can be electrically connected to the energy generator 105 via electric lines or conductors, integrally formed, or directly connected to each other. Furthermore, the energy generation system can be placed in any configuration to other downhole devices such as for example the packer or plug system 102, the gauge 104, and the telemetry system 103. The configuration illustrated in FIG. 1 is merely to illustrate one possible application of the invention.

Figure 2:
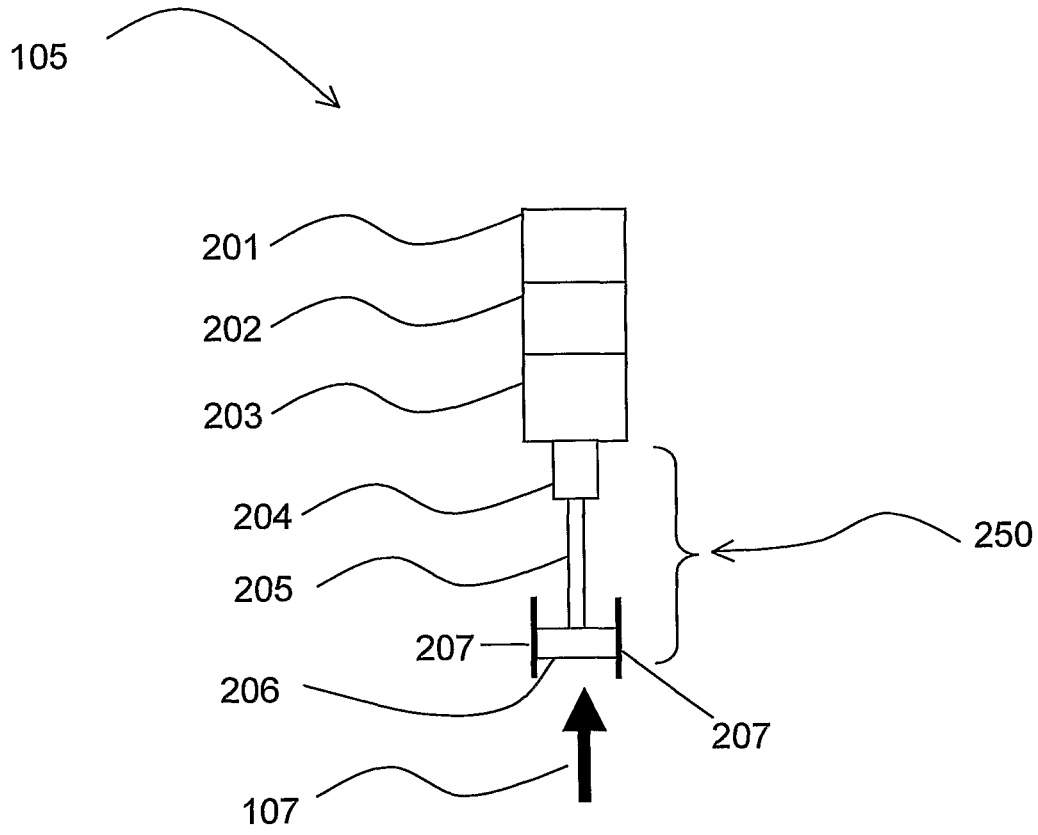
FIG. 2 shows the energy generation module of FIG. 1 in more detail.

In FIG. 2 the energy generator 105 is representatively illustrated in more detail. Other system components from FIG. 1, such as gauge 104, telemetry system 103 and packer 102 are not shown in FIG. 2. Neither is the well 101, 108. The embodiment of the present invention illustrated in FIG. 2, shows an energy generator 105 that comprises a energy storage module 201, typically comprising at least two rechargeable batteries, an electronics module 202, an energy harvester module 203, and a vibrating assembly 250. The vibrating assembly comprises a flexible tuning device 204, an elongated arm 205, and a crossbar 206. In a preferred embodiment, the crossbar 206 is a vortex shedding device, which typically has a specific shape and geometry required to maximize interaction, hence vortex shedding, as a result of interaction between the fluid flow 107 and the crossbar 206.

Vortex shedding is a well known scientific phenomenon, where a physical body submerged in a flowing fluid entail a so-called Von Karman vortex street along and in the downstream wake of the submerged object. Typically, these vortices follow a relatively predictable, alternating pattern that creates resulting alternating lift forces on the submerged object, which in turn may cause the object to oscillate. The frequency of the vortex oscillation is a physical relation between velocity and physical properties of the fluid and shape/geometry of the submerged object and can be estimated with a given certainty, further to the so-called Strouhal number. In particular, the frequency of the induced vortices increases as flow velocity increase, and furthermore the frequency and strength of vortex shedding is related to the Reynolds number, Re. It is of importance that the Reynolds number is not above "Supercritical" as this will induce no vortex shedding. Furthermore, if the Reynolds number is in the sub critical range the frequency of the vortex shedding is very low.

The resulting oscillations from vortex shedding are not illustrated in FIG. 2 as this takes place along an axis perpendicular to this view.

The geometry, shape and accessories related to the crossbar 206 may be optimised to generate as good an interaction with the flow 107 as possible, hence generate an optimal energy output of the downhole energy generator system. In a preferred embodiment of the invention, such optimisation is to be achieved by the aid of Computational Fluid Dynamics (CFD) simulations and/or physical testing.

The fluid flow represented by arrows 107 may include one or more liquids (such as oil, water, gas condensate, etc.) one or more gases (such as natural gas, air, nitrogen, etc.) one or more solids (such as sand, scale deposits, cuttings related to drilling, artificial sands, etc.) or any combination of liquids and/or gases and/or solids.

Furthermore to FIG. 2, as the fluid flow 107 hits and interacts with the crossbar 206, the crossbar sheds vortices in said asymmetric pattern, which in turn produces alternating said lift forces on the crossbar 206 and elongated arm 205. Hence, the crossbar and arm will vibrate, and in a preferred embodiment the majority of the vibrations will be in one singular plane, along one single axis. For reference, in this document, this is referred to as the y-axis. As a remark, typically a vibrating assembly according to the invention will have an attachment point/pivot point, and said vibrations will be of a slightly bent character centering on the pivot point, and for the purpose of illustration, oscillations/displacement is defined to have most of its components along the y-axis.

To generate oscillating lift forces that are dominant in one axis, which is normally desirable, the main body of the crossbar 206 (the "bluff body") could be made in the form of a rectangular shaped box or an elliptic shaped, cylindrical container, or similar (for instance a combination of the two mentioned shapes and other shapes with geometrical shapes that creates a dominant symmetry with respect to vortex shedding taking place in the direction of one desired axis). Research undertaken by the applicant of this patent application has surprisingly revealed that for "pure" bluff bodies, such as a rectangular shaped box, vortex shedding along the desired axis can be suppressed/dampened due to high-velocity flow along the "short ends" of the crossbar 206. Typically, the short ends of the crossbar will be closer to the wall of the well 101 than other surfaces of the crossbar, and as a result, fluid velocity will be higher in the section between the short ends of the crossbar and the inner wall of the well 101. Said research has revealed that the high velocity fluid streams from this area may disturb/suppress the desired vortex shedding process along the desired axis (y-axis). In other words, CFD simulations have revealed that vortex shedding in two perpendicular planes may reduce/suppress each other, and it is of importance to eliminate all vortex shedding in one of the two (the "wrong/non desired) planes to optimize the vortex shedding in the other (desired) plane such that the lift forces are maximized. To prevent the undesired vortex shedding/disturbing turbulence along the z-axis taking place in the near-wake of the crossbar, one can add one or more shields 207 to the crossbar 206. As it is of interest to produce the lift forces over the largest area of the crossbar, the shields 207 are included on the short sides of the crossbar 206 as shown in FIG. 2. By means, the desired vortex shedding process, entailing oscillations along the y-axis can be optimised, entailing an optimised energy output from the downhole energy generator 105.

The energy storage module 201 typically comprises 2 or more rechargeable batteries. In general, a rechargeable battery can not be charged and provide power simultaneously. Hence, a most typical configuration in a preferred embodiment of the invention comprise at least 2 rechargeable batteries, preferably more than 2 batteries in order to provide for backup should one battery cell fail, as well as a smooth, uninterrupted system operation, not being disturbed by voltage spikes at the time of changing being powered from one battery cell to another. In another embodiment of the invention, the energy storage module 201 comprises one or more capacitors. In a preferred embodiment of the invention, the capacitors are super capacitors.

Figure 3:
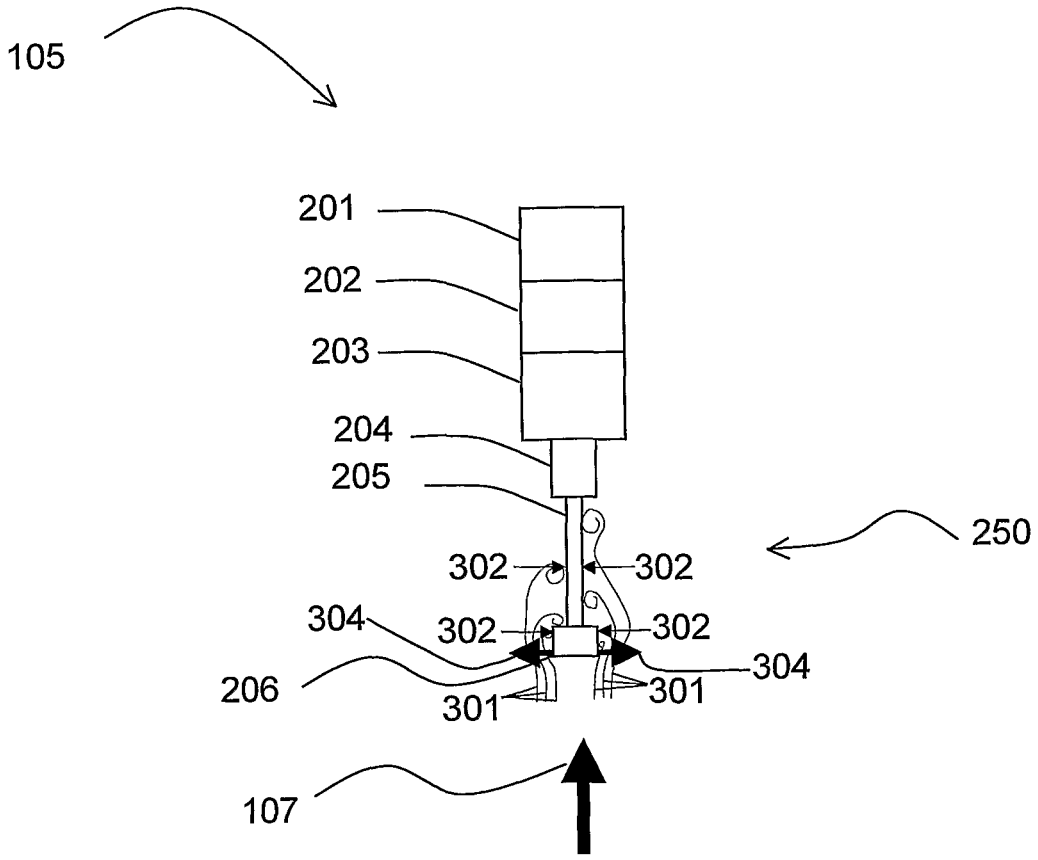
FIG. 3 shows the interaction between the energy generation module of FIGS. 1 and 2 and the fluid flow of the well.

FIG. 3 illustrates the energy generator 105 in a view perpendicular to the one illustrated in FIG. 2. The shields 207 are excluded from this view to better illustrate the vortices 301 shed over the crossbar 206, and how these vortices impinge on the lateral surfaces of the crossbar 206 and the elongated arm 205. These vortices will produce alternating lift forces, which act on the lateral surfaces of the crossbar 206 and the arm 205, as represented by arrows 302. The resulting oscillating lift force will cause the crossbar 206 and the arm 205 to displace back and forth along the y-axis, as represented by arrows 304.

The frequency of the fluid imposed oscillations 304 imposed on the arm 205 and the crossbar 206 are relying on factors such as the velocity and physical properties of the fluid and shape/geometry of the crossbar, as mentioned earlier.

Furthermore, to achieve an optimal energy output from the downhole energy generator 105, it is desired to "tune" the mechanical properties of the vibrating assembly 250 so that the natural oscillating frequency of the mechanical system to a substantial degree match the fluid imposed alternating lift forces. In a preferred embodiment, the frequency of the fluid imposed, varying lift force oscillations 304, match the natural oscillating frequency of the assembly 250 to a significant degree, so that resonance occurs and system energy is optimised. This again will entail optimal system performance with respect to energy generation, i.e. generation of electrical power.

The natural oscillating frequency of the vibrating assembly 250 is generally a function of stiffness and weight of the arm 205 and the crossbar 206. To a certain degree, a frequency match could be achieved by choosing a correct weight/stiffness relation. However, in a preferred embodiment of this invention, the natural oscillating frequency of the vibrating assembly 250 is controlled by a flexible tuning device 204, which comprise means for adjusting the flexibility/stiffness/spring constant of the vibrating assembly 250.

In a one embodiment, the flexible tuning device 204 will mechanically bias the vibrating assembly 250 towards a neutral position, radial centred, i.e. radial tension in the flexible tuning device 204 will increase as vortices are shed over the crossbar 206 and this deflects. In that way, in a preferred embodiment of the invention, the vibrating assembly will oscillate around a neutral-point, along the desired axis as described above.

In a preferred embodiment of the invention, the flexible tuning device 204 can be adjusted autonomously during operation if flow and/or fluid parameters change, such that the natural oscillating frequency of the vibrating assembly 250 to a significant degree will correspond with the fluid imposed, oscillating frequency. For this embodiment, the downhole energy generation process can be optimized at all times without having to retrieve the energy generator to surface.

In one embodiment, the flexible tuning device 204 comprise sensoring devices for the registration of (negative) changes is in system performance, such as reduced energy levels measured by an accelerometer or by direct measurement of energy harvester output by means of electric energy. Further, upon indication of said changes, the energy generator system 105 possesses capabilities to change the natural oscillating frequency of the vibration assembly 250. In one embodiment, the flexible tuning device 204 comprises an actuator operating a spring, such as a progressive spring, to change the stiffness/spring constant of the vibrating assembly, hence the natural oscillating frequency of the vibration assembly 250. In another embodiment, the active tuning module comprise a mass-transfer system/function in order to change the dominating oscillating mass of the vibration system 250, hence the natural oscillating frequency. In a third embodiment, the tuning is achieved by means of controlling the electric output from an electric tuning device, such as a generator (magnet/coil assembly) and/or applying required electric resistance to the output circuit. In a general embodiment, tuning is achieved by a combination of the above mentioned methods. In one embodiment, said frequency tuning is controlled by a pre-programmed logic routine, based on upfront simulations related to the given well/hardware configuration. In another embodiment, the frequency tuning is achieved by performing one/more sweeps, for instance by compressing a progressive spring from one predetermined set value to another set value, while monitoring at which compression/displacement the energy output, alternatively energy level (accelerometer reading) is at maximum.

As mentioned, the natural oscillating frequency of the vibrating system 250 can be determined for various geometries of the crossbar 206 and various flow and fluid parameters with aid of CFD analysis and empirical relationships guided by testing of the present invention. In relation to rigidity and stiffness of the vibrating assembly 250, for a preferred embodiment of the invention, the flexible tuning device 204 is of substantially less rigidity and stiffness than the arm 205 and the crossbar 206, such that the arm 205 is not substantially bent along its length during the vibrations 304.

Figure 4:
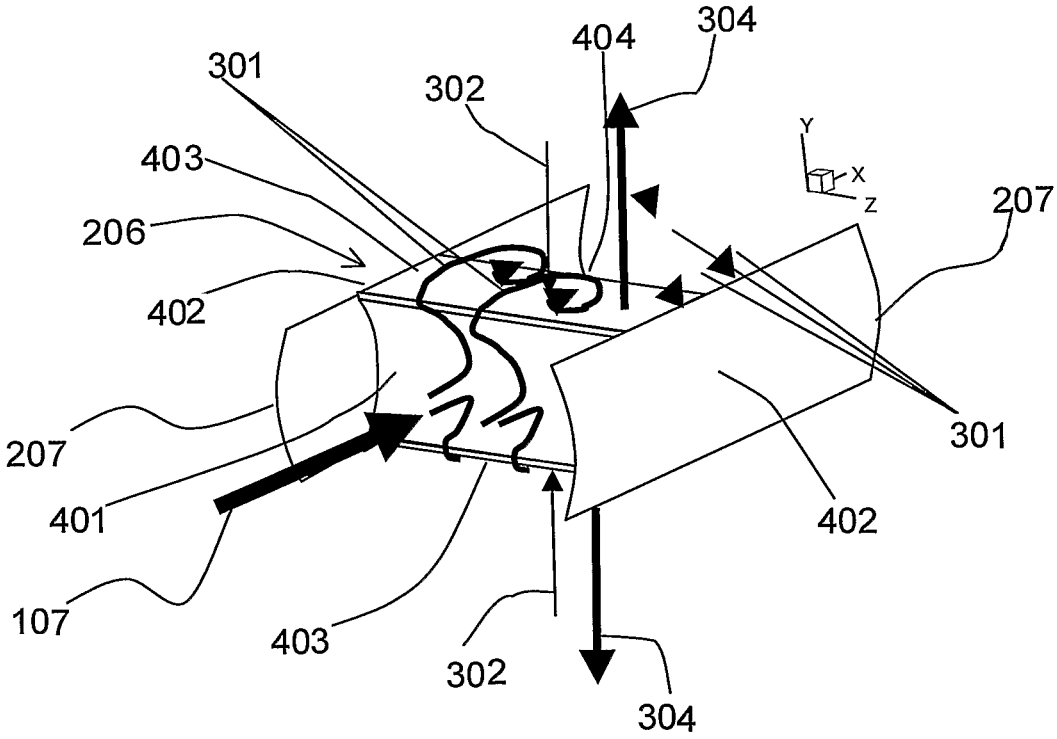
FIG. 4 shows one embodiment of a crossbar and accessories, i.e. system elements that are designed in order to interact with the flowing well fluid(s) in order to generate vibrations.

A preferred embodiment of the crossbar 206 is shown in FIG. 4. Here, the crossbar 206 has a rectangular cross sectional shape perpendicular to the flow, and furthermore the surface facing the flow 107 has a concave shape, and the backside 404 is flat. The surfaces on the short ends 402 of the crossbar which are in parallel to the flow direction 107 are equipped with shields 207 to avoid unwanted vortex shedding along the y-axis, (an example of a first direction), and as a result a dominant vortex shedding turbulence picture 301 is generated over the surfaces 403 parallel to the flow direction 107 (an example of a second direction) and the downstream wake of the crossbar 206. In a preferred embodiment the length of the shield extends 1.5 to 6 times, more preferably 2 to 5 times, and most preferably about 3 times the cross sectional length of the crossbar along the z-axis downstream and 0.5 to 2, preferably about 1 time the cross sectional length of the crossbar along the z-axis upstream as indicated in FIG. 4.

In an embodiment that has proven to be very effective, the surfaces 403 parallel to the flow direction 107 has the largest area compared to the other surfaces 402 parallel to the flow direction. In this preferred embodiment, the oscillating lift forces 302 will act on the largest surfaces parallel to the flow 107, and the magnitude of the forces 302, which induce the vibrations 304, are maximized.

Figure 5:
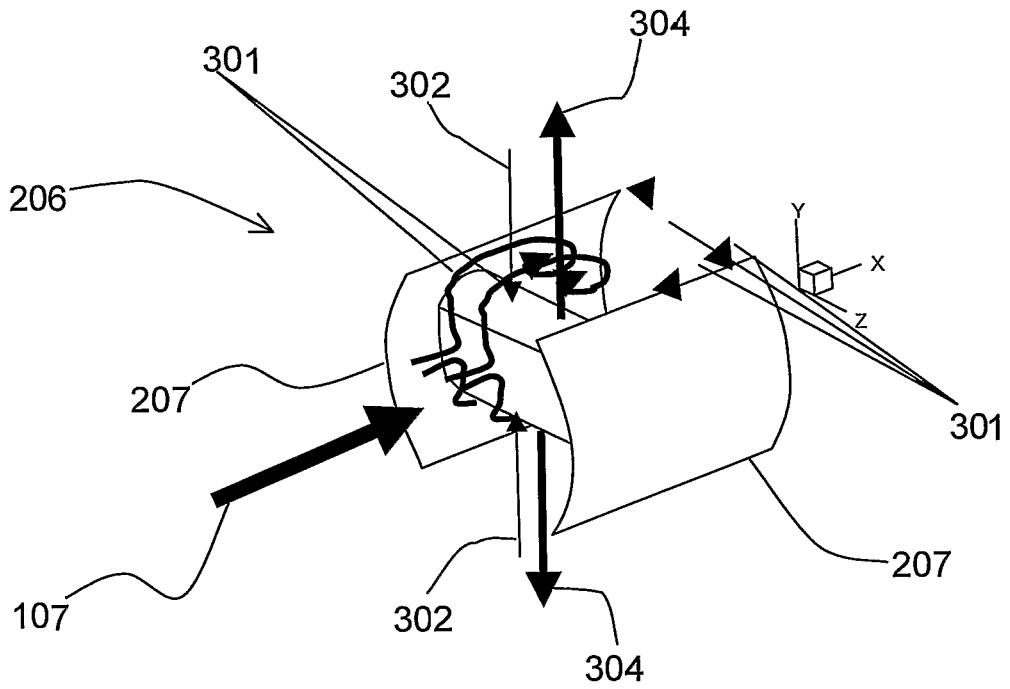
FIG. 5 shows an alternative embodiment of a crossbar.

Another but less effective configuration is presented in FIG. 5. Here, the cross section of the crossbar 206 in the cut parallel to the short ends 402, cut in the flow direction, is elliptic rather than "rectangle/square with one concave side" as shown in FIG. 4. Besides from that, FIG. 5 shows the same system components and processes as are illustrated in FIG. 4.

Figure 6:
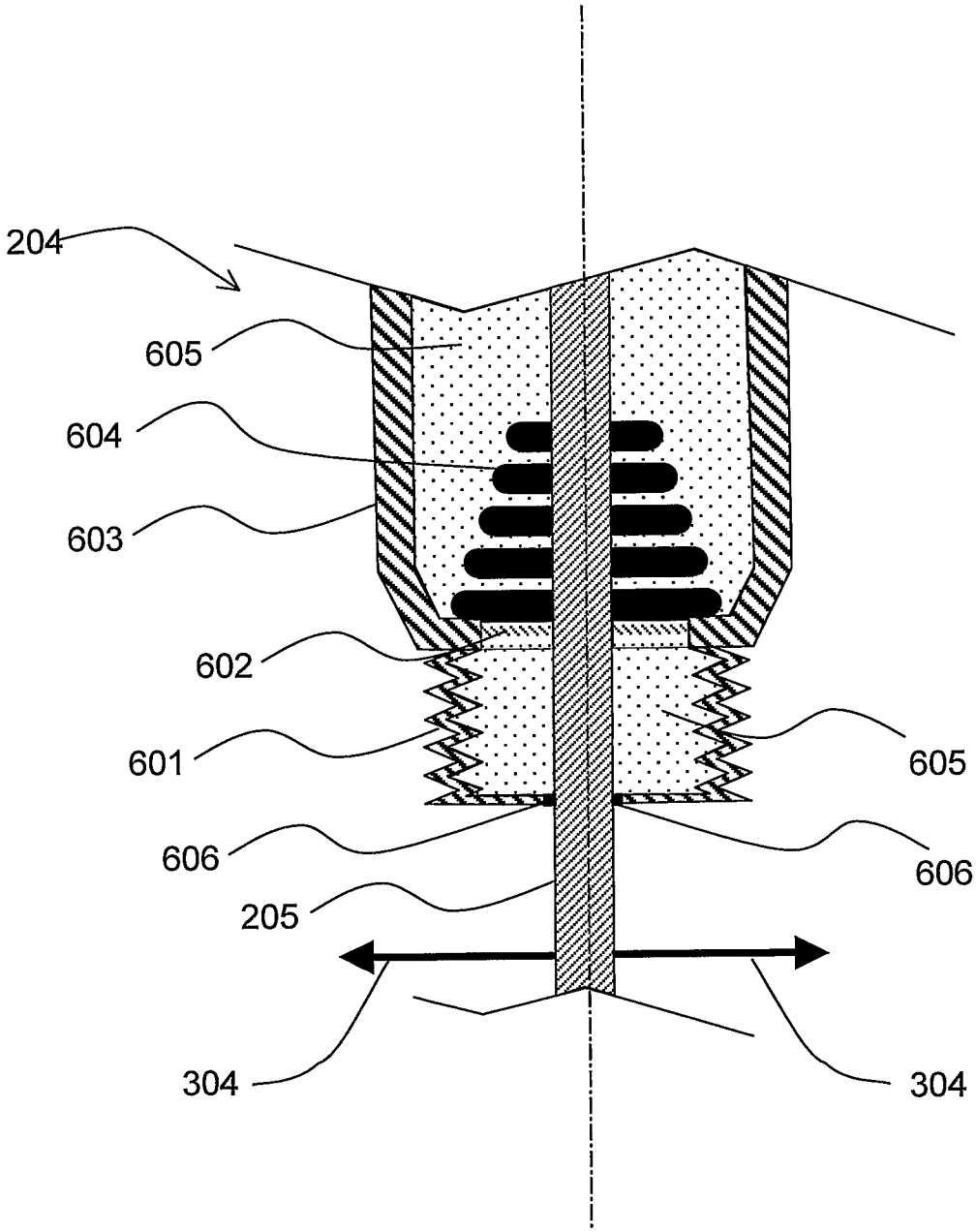
FIG. 6 shows basic elements of a flexible connection and mechanical tuning device of the system of the invention.

One embodiment of the flexible tuning device 204 is illustrated in FIG. 6. Here, the flexible tuning device 204 comprises a pressure compensation device 601, such as for example a steel bellow/process bellow, a flexible (such as a hinged) attachment joint 602 which allows the arm 205 to pivot, a pressure housing 603, a stiffness alteration device 604 in the form of a progressive spring, and seal device 606 required to prevent leakage of wellbore fluids into the flexible tuning device 204 and leakage of internal fluid 605 to the wellbore. In the illustrated embodiment of the invention, the seal device 606 forms an integral part of the pressure compensation device 601. However, for other embodiments of the invention, these could be separate elements. The flexible tuning device 204 and/or the pressure housing 603 may be filled with a fluid 605. The fluid 605 may can be any type of gas or liquid.

In a preferred embodiment of the invention the flexible tuning device 204 and/or the pressure housing 603 is filled with a gas, and the interface between the vibrating assembly 250 and the pressure compensated area of the device is a metal process bellows 601. By means, a gas filled environment would impose far less damping on an oscillating magnet/coil assembly than a liquid filled environment. Further, a flexible metal bellows would provide for a mechanically very flexible connection between the vibrating assembly 250 and a magnet/coil assembly in the embodiment where the latter is mounted inside a gas filled pressure-housing 603. Both the said factors would contribute to optimise the electric energy output.

Further, for a gas filled compensated pressure housing containing a magnet/coil assembly, in a preferred embodiment, such compartment would be associated with a progressive/gradually compensating system sourcing gas from an in-built high-pressure gas compartment while intervening the system in the well. In that manner, the flexible process bellows 601 would not suffer from mechanical damage neither during installation or downhole use. An associated pressure bleed-off system would allow also for a safe retrieval of the system out of the well.

Further to FIG. 6, the pressure compensation device 601 will assure that the internal pressure in the flexible tuning device 204 and/or pressure housing 603 is the same as the external wellbore pressure, and as a result all mechanical movement will occur in an equal pressure environment on both sides of the flexible attachment joint 602 and furthermore all forces related to pressure differential are diminished.

The pressure housing 603 may or may not include both the flexible tuning device 204 and the energy harvester module 203, cf. FIG. 3. In FIG. 6 the flexible attachment joint 602 is placed at a point in between the two ends of the arm 205 and as a result there is a defined freedom of movement of the arm 205 within the housing 603. Furthermore, for this embodiment of the invention, the stiffness alteration device 604 is placed within the housing 603.

As explained in relation to FIG. 3, in a preferred embodiment of the invention it is of interest to equip the energy generator 105 with logic to control the rigidity and stiffness of the vibrating assembly 250, such that one can tune the vibration assembly 250 natural oscillating frequency to match the flow imposed vortex shedding frequency. For the embodiment as depicted in FIG. 6, this is achieved by adjustment of the progressive stiffness alteration device 604, which in this FIG. 6 encompasses a progressive spring. A combination of various types of springs may also be possible. Hence, for this embodiment, the rigidity and stiffness of the stiffness alteration device 604 can be adjusted by means of an actuator working to compress/elongate a spring such as a progressive spring. Said actuator principle is well known to one skilled in the art and is therefore not shown in FIG. 6. Furthermore, said actuator may be of a pneumatic, and/or hydraulic, and/or electrical or other nature. For the embodiment as depicted in FIG. 6, system tuning is achieved by increasing or decreasing the spring tension by compressing or decompressing the spring respectively. The electronics module 202 includes means for determining the optimum stiffness of the stiffness alteration device 604. As mentioned above this can be achieved by a sweep, where the stiffness alteration device 604 will be adjusted from minimum to maximum, whilst the electronics module 202 will measure resulting frequency and energy output, and thereafter adjust the stiffness alteration device 604 to the position which yields an optimized resonance frequency (as explained in relation to FIG. 3 and above in this paragraph). Furthermore to this example, for the given embodiment, if the parameters of the fluid flow 107 changes such that the efficiency of the energy generator changes, the logic will run a sweep to determine the optimum stiffness of the stiffness alteration device according to the new parameters of the fluid flow 107. By such a method the energy generator will autonomously adjust itself into the most efficient setup based on the parameters of the fluid flow 107.

In one embodiment of the invention, whole or parts of the stiffness alteration device 604, as well as any other illustrated or mentioned system component, may be located outside said pressure housing 603 and/or pressure compensating device 601.

The seal device 606 may include a threaded interface, but such technology is known to one skilled in the art and is therefore not explained in further detail. Furthermore, the flexible attachment joint 602 is based on standard mechanical principles for flexible attachment of mechanical components, such as hinged joints, and is therefore not explained in further detail herein.

Figure 7:
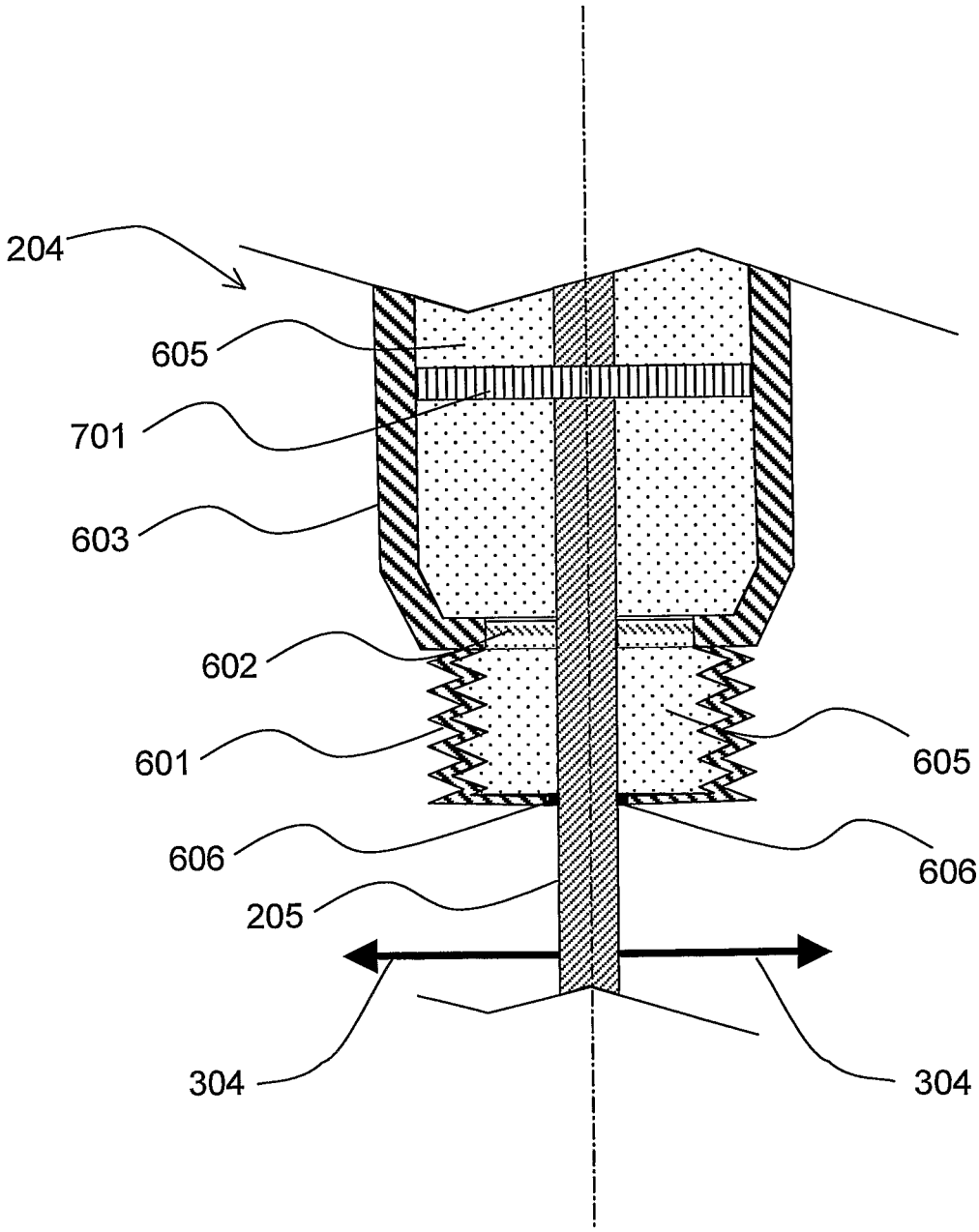
FIG. 7 shows an alternative embodiment to what is shown in FIG. 6.

Another embodiment of the flexible tuning device 204 is depicted in FIG. 7, comprising a pressure compensation device 601, such as a steel bellow, a flexible attachment joint 602 which allows the arm 205 to pivot, a pressure housing 603, a stiffness alteration device 701, and seal device 606 required to prevent leakage of wellbore fluids into the flexible tuning device 204 and leakage of internal fluid 605 to the wellbore. The flexible tuning device is filled with a fluid 605, which can be any type of gas or liquid. Most features of FIG. 7 overlap with what is described in FIG. 6, with the exeption of the progressive stiffness alteration device 701. The progressive stiffness alteration device illustrated in FIG. 7 is explained in further detail in FIG. 9.

For the embodiment as depicted in FIG. 7, frequency tuning is achieved by increasing or decreasing tension in one or a set of springs (not shown) by compressing or decompressing the spring(s) respectively. Said spring system may encompass one/numerous spring(s) such as a progressive spring or a combination of types of springs.

In a preferred embodiment, the system logic includes means for determining the optimum stiffness of the stiffness alteration device 701. As an example this can be achieved by a sweep, where the stiffness alteration device 701 will be adjusted from minimum to maximum, whilst the sensor/electronics/logic will measure resulting effect, such as energy output, and thereafter adjust the stiffness alteration device 701 to the position which yields an optimized energy generation (as explained in relation to FIG. 3 and above in this paragraph). Furthermore to this example, if the parameters of the fluid flow 107 changes such that the efficiency of the energy generator changes, the logic will re-run said sweep to re-determine the optimum stiffness of the stiffness alteration device according to the new parameters of the fluid flow 107. By such a method the energy generator will autonomously adjust itself into the most efficient setup as a response to any change of parameters of the fluid flow 107.

Figure 8:
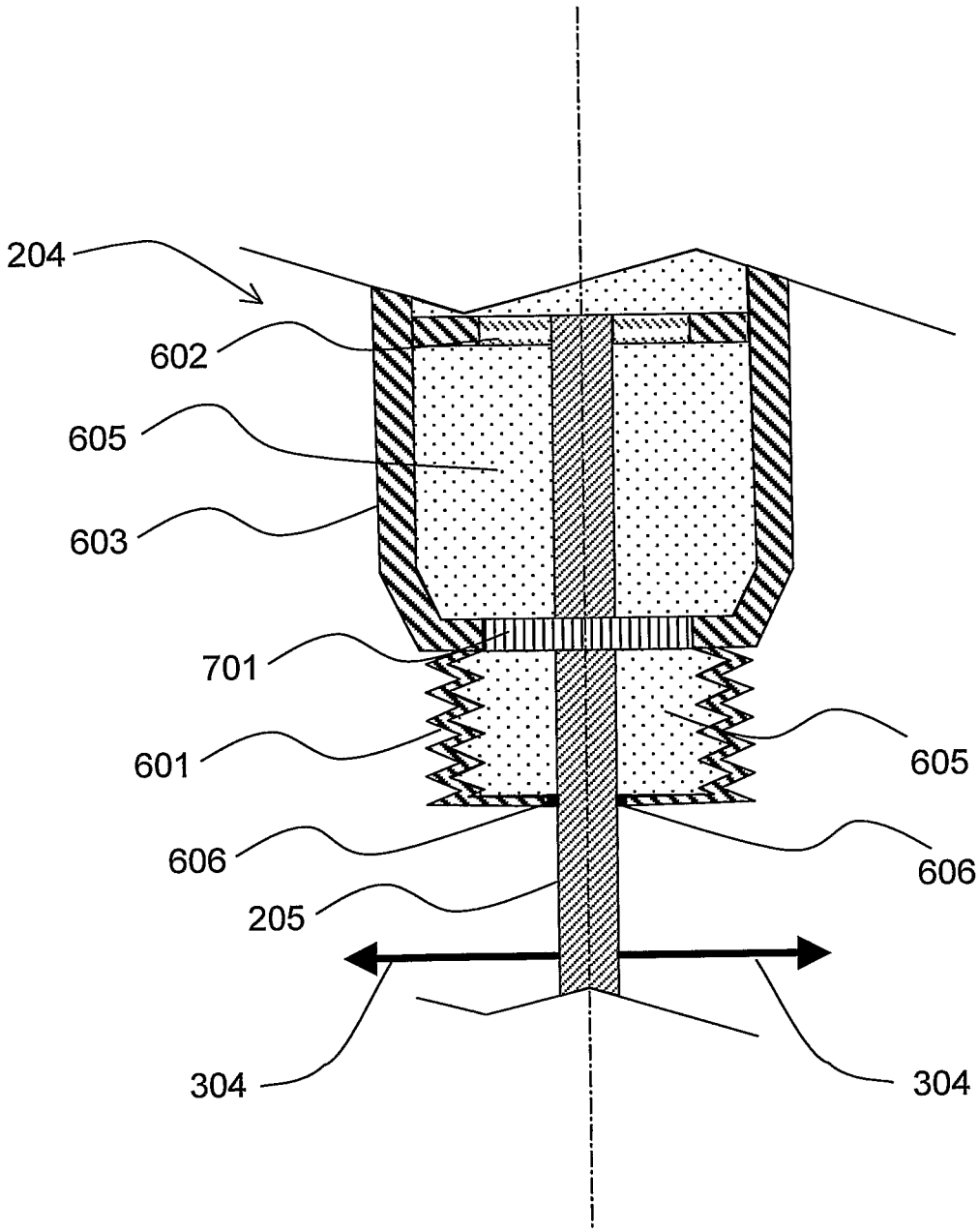
FIG. 8 shows yet an alternative embodiment to what is shown in FIG. 6.

Even another embodiment of the flexible tuning device 204 is depicted in FIG. 8, comprising a pressure compensation device 601, such as for example a steel bellow, a flexible attachment joint 602 which allows the arm 205 to pivot, a pressure housing 603, a stiffness alteration device 701, and seal device 606 required to prevent leakage of wellbore fluids into the flexible tuning device 204 and leakage of internal fluid 605 to the wellbore. Most features of FIG. 8 overlap with what is described in FIG. 6 and FIG. 7, with a main exception: The setup of the flexible attachment joint 602 and the stiffness alteration device 701 in FIG. 8 is different from the setup as depicted in FIG. 6 and FIG. 7. In FIG. 8 the flexible attachment joint 602 is placed within the housing 603 at a termination point (end point) of the arm 205, and as a result there is no internal free end movement of the arm within the housing. Furthermore, the stiffness alteration device 701 is placed at a point in between the two ends of the arm 205.

For the embodiment as depicted in FIG. 8, system tuning is achieved by adjustment of the progressive stiffness alteration device 701. The rigidity and stiffness of the stiffness alteration device 701 can be adjusted, up-front the operation or autonomous during operation, by means similar to the methods described herein, such as for FIGS. 6 and 7.

Figure 9:
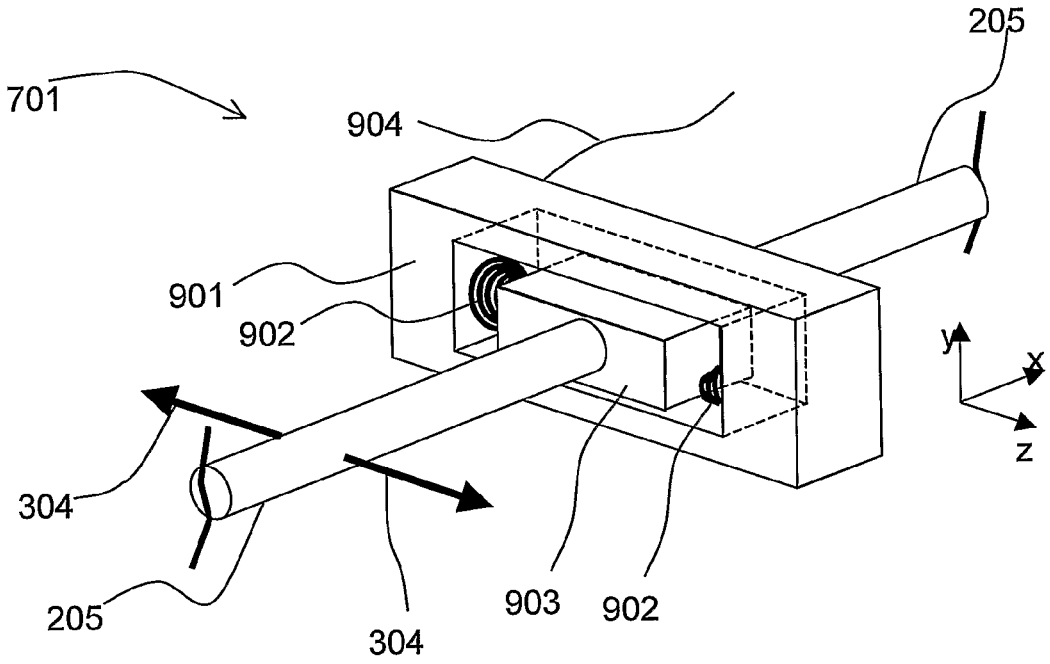
FIG. 9 shows details of an embodiment related to mechanical tuning of the system of the invention.

In FIG. 9 the stiffness alteration device 701 is explained in further detail. The device 701 comprises a guide housing 901, a set of adjustable counteractive devices 902 in the form of progressive springs, and a guide 903. As mentioned in relation to FIG. 8, the rigidity and stiffness of the stiffness alteration device 701 can be adjusted by means of an actuator principle. In more detail, for the embodiment as shown herein, the adjustable counteractive devices 902 can be adjusted by means of an actuator principle. Such an actuator principle is well known to one skilled in the art and is therefore not shown in FIG. 9. Furthermore, such an actuator may be of a pneumatic, and/or hydraulic, and/or electrical nature. For the embodiment shown in FIG. 9, system tuning is achieved by increasing or decreasing tension of the springs (as part of devices 902) by compressing or decompressing the springs respectively. The actuator (not shown) may be connected to the electronics module 202 via communication lines 904. Communication lines 904 may be electrical and/or hydraulic and/or pneumatic.

During system operation, the guide 903 is fixed at a predetermined position on the arm 205, said position is preferably determined by requirements to free end amplitude and the tuning with respect to frequency of the fluid imposed oscillations 304. Further, during operation, the oscillating arm 205 will be guided back and forth between the adjustable counteractive devices 902, whereas the adjustable counteractive devices 902 bias the oscillating arm towards neutral (centered) position inside the guide housing 901. In similar manners as described in earlier sections, the natural oscillating frequency of the system can be changed utilizing the adjustable counteractive devices 902.

In one embodiment the stiffness alteration device 701 can be designed to generate electrical energy, hence become a part of the direct energy harvesting process. This can be achieved by making the guide 903 partly or fully of a magnetic material, and mount electric coils within the guide housing 901 or vice versa. Such a system module can both serve the function as a partial energy harvester of the system and perhaps more importantly, be used to actively tune the natural oscillation frequency of the vibration assembly 250. The methods for energy generation utilizing a magnet and coil are well known for one skilled in the art and are therefore not shown in FIG. 9.

Figure 10:
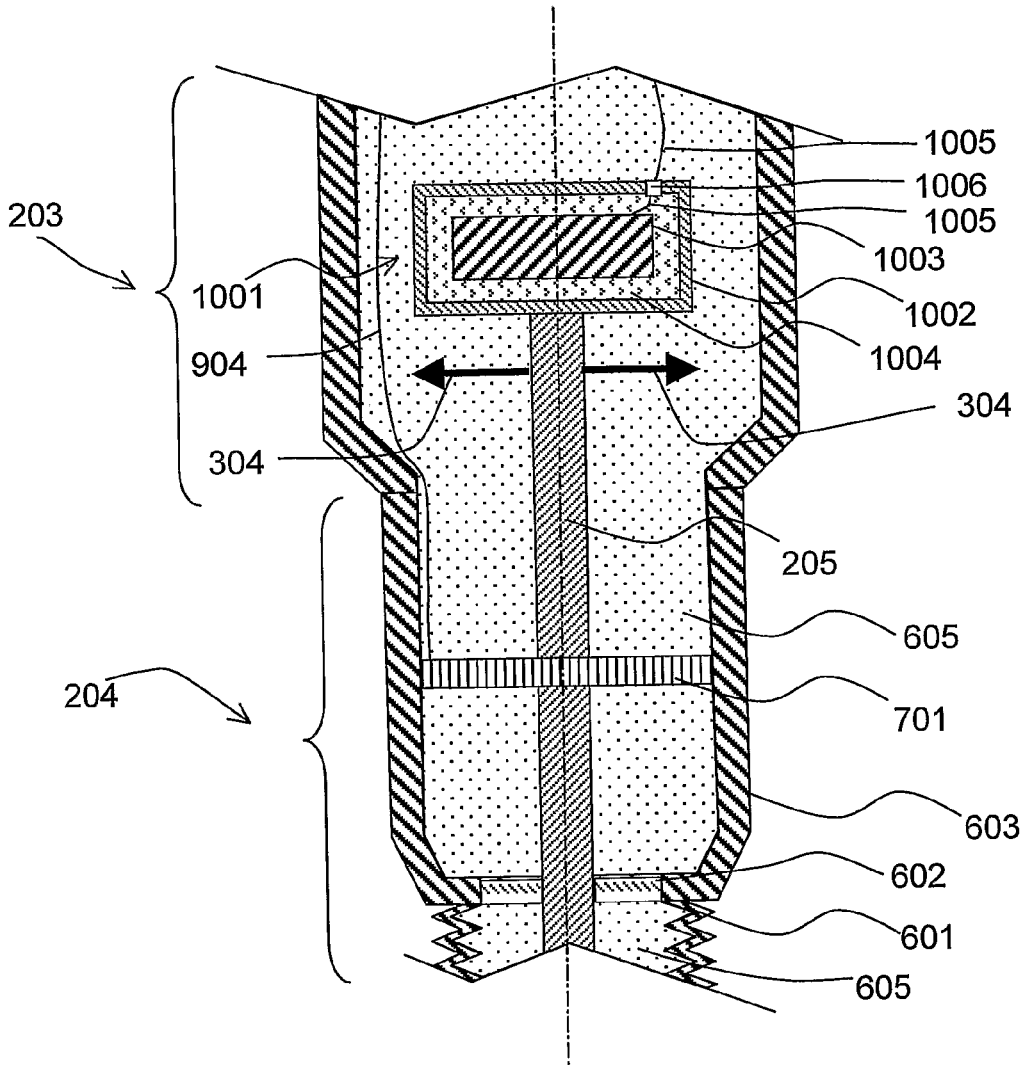
FIG. 10 shows one embodiment of the energy harvesting process, i.e. conversion from mechanical energy to electric energy.

According to an embodiment of the present invention depicted in FIG. 10, energy is generated within the energy harvester module 203. In this embodiment, the energy harvester module 203 is contained within the same housing 603 as the flexible tuning device 204, but in other embodiments these may also be separated into two different housings.

In this embodiment, the energy harvester module 203 comprises an energy harvester 1001, defined as a mechanical-to-electrical energy converter (such as a magnet/coil assembly) herein, which is attached to the free end of the arm 205 that is inside the housing 603.

In this embodiment, the energy harvester 1001 comprises a housing 1002 filled with a fluid 1004, and internal components 1003. The energy harvester 1001 may be based on a magnet and coil principle, but any type harvester which utilizes an oscillating motion to generate energy will be applicable. As such harvester technology exists and is readily available in the market, the harvester 1001 of FIG. 10 is merely depicted as a housing 1002 with internal components 1003, surrounded by gas or liquid 1004. The harvester is typically electrically connected to the electronics module 202 via electric communication lines 1005, which are directed through the housing 1002 via a barrier 1006 providing a pressure barrier and electrical feed through for the communication lines 1005.

In one embodiment, the housing 1002 is omitted, and the internal components 1003 (the electric energy generating part of the harvester 1001) are exposed to the same internal fluid, pressure and other parameters as are present inside the pressure housing 603. Further, in one embodiment, at least parts of the internal components 1003 are fixed to the housing 603. As an example, a magnet/magnets could be attached to the arm 205 and a coil/coil assembly attached to the pressure housing 603 body. In a preferred embodiment of the invention, the coil element(s) is attached to the oscillating parts of the system, whereas the magnet element(s) is attached to a fixed, static part of the system such as the pressure housing 603 body.

To summarise, for the embodiment as depicted in FIG. 10, the vibrations 304 resulting from the vortex shedding process will be transferred to the internal end of the elongated arm 205 (on the part that is located on the inner side of the flexible attachment joint, away from the well fluids), and hence the energy harvester 1001 will be subjected to these vibrations 304, which in turn are transformed to electrical energy by said energy harvester 1001. In addition, in one embodiment of the invention, electric energy can also be fully or partly generated in the stiffness alteration device 701 as explained in relation to FIG. 9 above.

Figure 11:
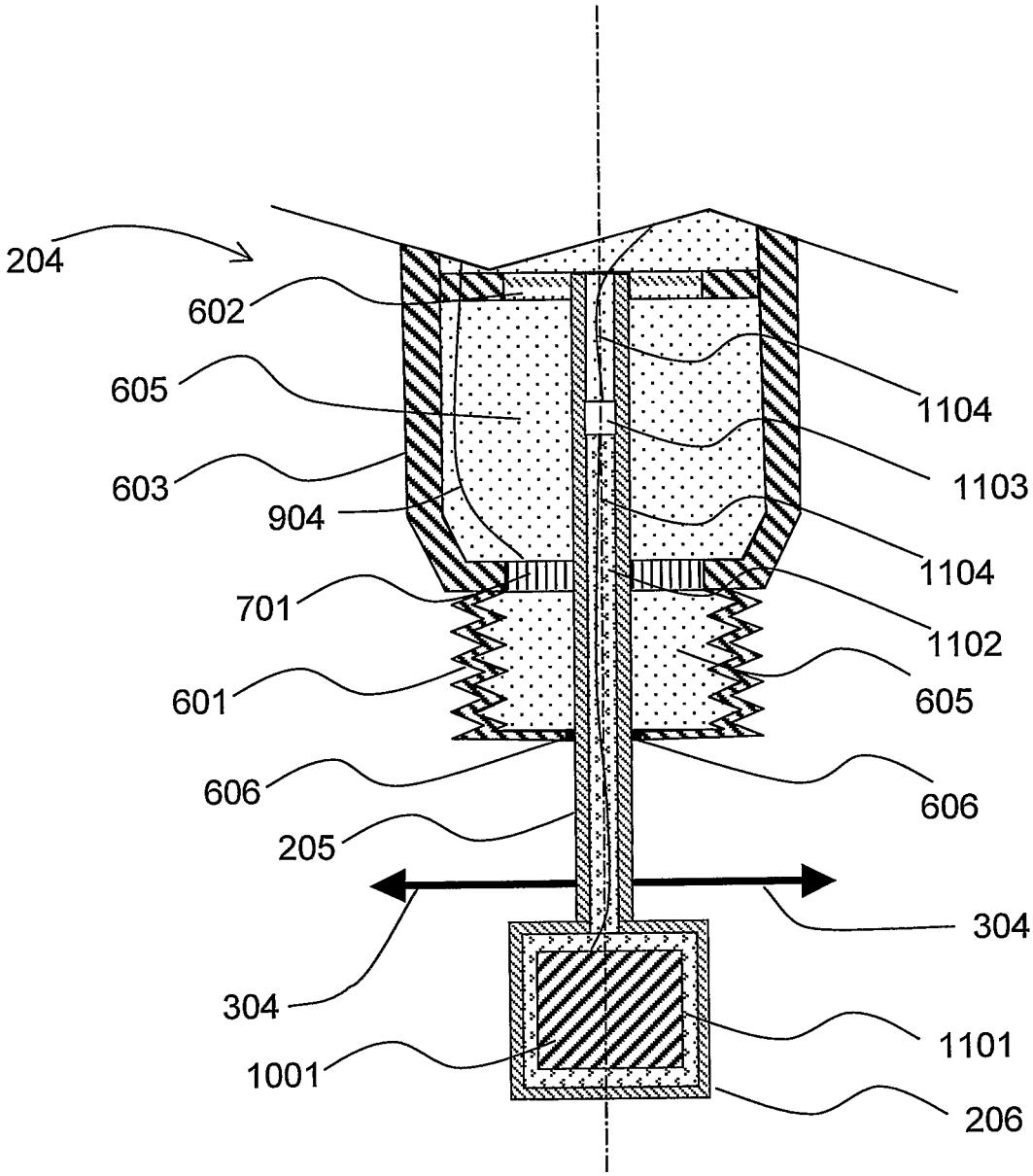
FIG. 11 shows another embodiment of the energy harvesting system and method.

Another preferred embodiment of the invention is depicted in FIG. 11, where the energy harvesting process takes place within the crossbar 206. Here, an energy harvester 1001 is placed inside the crossbar 206 and surrounded by a fluid 1101, which may be any type gas or liquid. This harvester 1001 may be a separate unit placed within the crossbar 206, or the crossbar 206 may form the energy harvester housing 1002 such that the energy harvester internal components would be directly mounted inside the crossbar 206. For this embodiment, the elongated arm 205 is provided with a bore 1102 and a barrier 1103 containing electrical connections that provides as a pressure barrier and electrical feed through for the electrical communication lines 1104 going from the energy harvester 1001 to the electronics module 202. Furthermore, the barrier 1103 will provide means for having a different pressure in the fluid 1101 contained by the crossbar 206 and the arm 205 compared the fluid 605 within the flexible tuning device 204.

A significant benefit with the embodiment depicted in FIG. 11 is that the energy harvester 1001 can be mounted in an atmospheric chamber, or even a vacuumed chamber. This will impose the absolutely least fluid-imposed damping on the energy harvester part of the system. An energy harvester mounted in a liquid environment would suffer from dampening due to the need for displacing fluid as a part of the oscillating process. Due to fluid inertia and drag, a significant part of the generated vibration energy might become lost in the energy harvesting process and be dissipated as heat. An analogue is to try to move a paddle through water with the flat end perpendicular to the direction of movement. The invention described herein, using a pressure compensated gas in the pressure housing 603 will reduce such damping significantly, but the very least damping would be achieved by mounting the energy harvester 1001 inside a vacuumed gas environment. The concept of reducing said fluid damping forms an important part of this invention.

Figure 12:
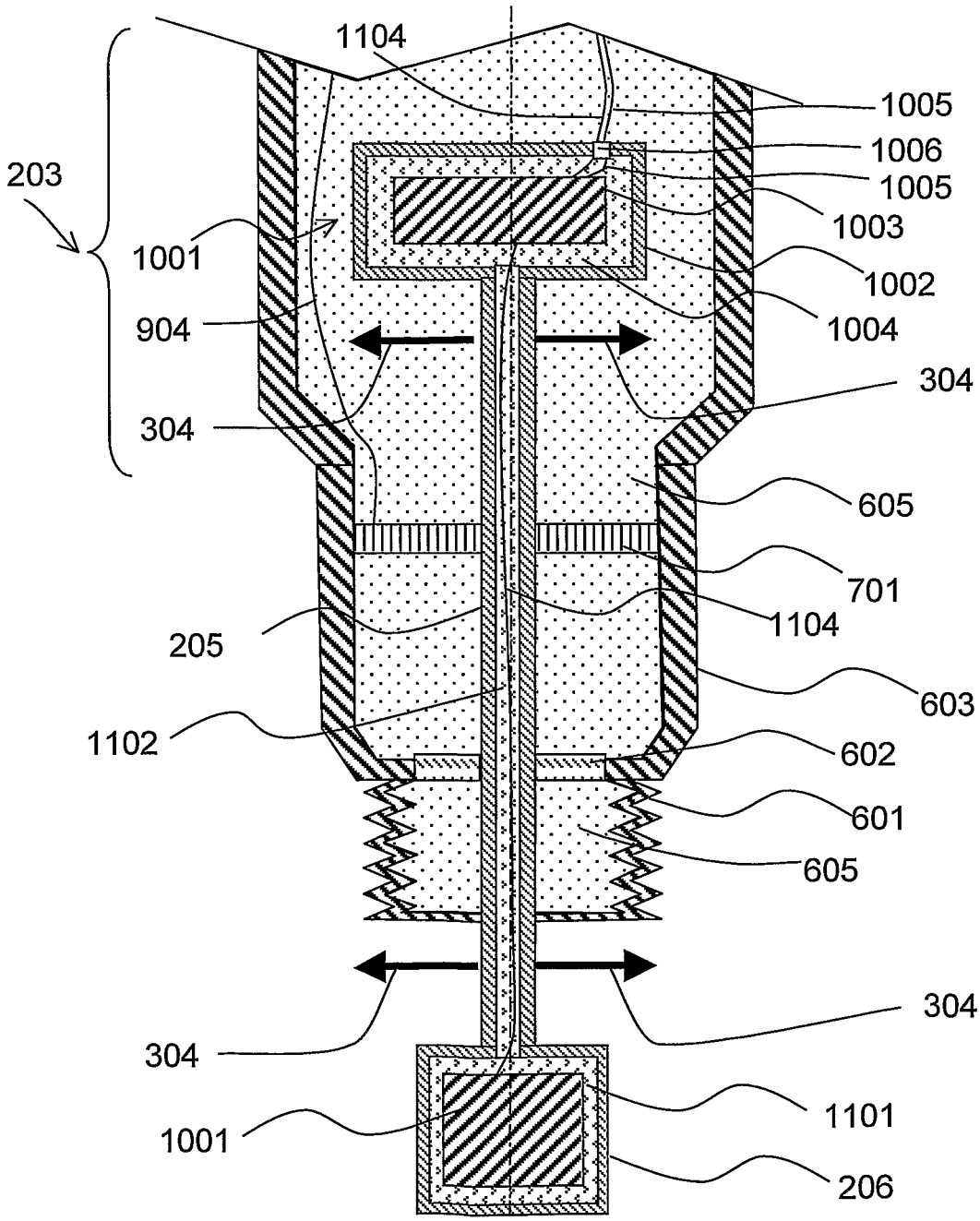
FIG. 12 shows yet another embodiment of the energy harvesting system and method.

In another embodiment, energy can be generated both in the crossbar 206, stiffness alteration device 701, and in a harvester mounted at the opposite end of the arm 205 of the crossbar 206, or in any combination of 2 of said locations. One example of such is presented in FIG. 12, where energy is generated both within the energy harvester module 203 and the crossbar 206, and the stiffness alteration device 701 as described in relation to FIG. 10 and FIG. 11 respectively. For the embodiment as depicted in FIG. 12, the fluid imposed vibrations 304 due to vortex shedding will act on the crossbar 206 and be transferred to the internal part of the elongated arm 205 (on the internal side of the flexible attachment joint), and hence the energy harvesters 1001 will be subjected to these vibrations 304 at both ends of the arm 205. In addition energy can be generated in the progressive stiffness alteration device 701 as explained in relation to FIG. 9 above.

Figure 13:
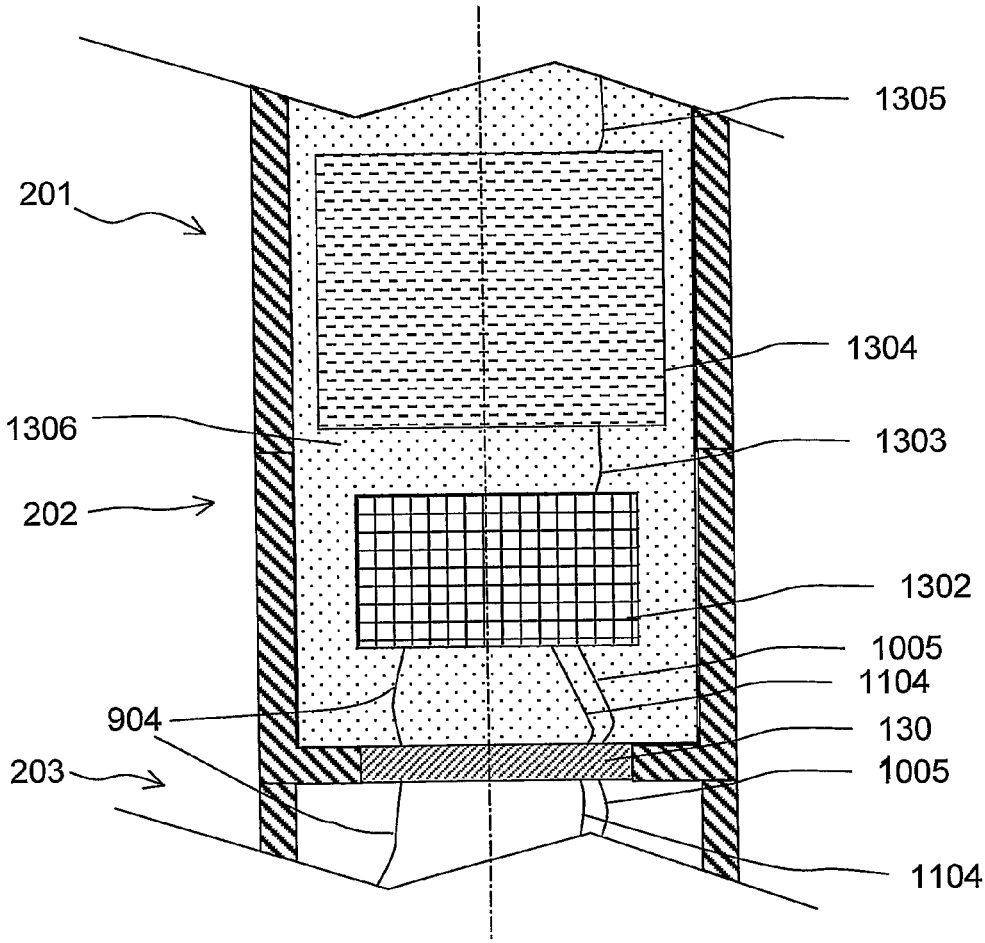
FIG. 13 shows an embodiment of electronics, logic and energy storage modules associated with the system of the invention.

In FIG. 13, one embodiment of the electronics module 202 and the battery module 201 is shown in more detail. Here, the electronics module 202 comprises an electronics circuit board 1302, which in a preferred embodiment comprises at least one microprocessor and a barrier 1301 containing electrical connections (not shown) from the pressure contained areas of the system. As the electronics and batteries normally will have to be mounted in an atmospheric pressure condition, the barrier 1301 provides both a pressure barrier and electrical feed through for the electrical communication lines 1104 and 1005 going from the energy harvester 1001 to the electronics module 202 and the communication lines 904 going from the electronics module 202 to the stiffness alteration device 701.

For this embodiment, the electronics circuit board 1302 is connected to a rechargeable battery pack 1304 via communication lines 1303, and the rechargeable battery pack 1304 is connected to a task execution device (not depicted in FIG. 13) via communication lines 1305. The task execution device can be such as but not limited to a valve, actuator, telemetry system, gauge, sensor, etc. The electronics module 202 and the battery module 201 are filled with a fluid 1306, which can be any type gas or liquid, typically at atmospheric pressure conditions. The electronics module 202 and the battery module 201 are not separated by a barrier in this illustration. However, in other embodiments these modules may be separated by a barrier, such as barrier 1301, which includes electrical feed through for electrical communication lines.

Figure 14:
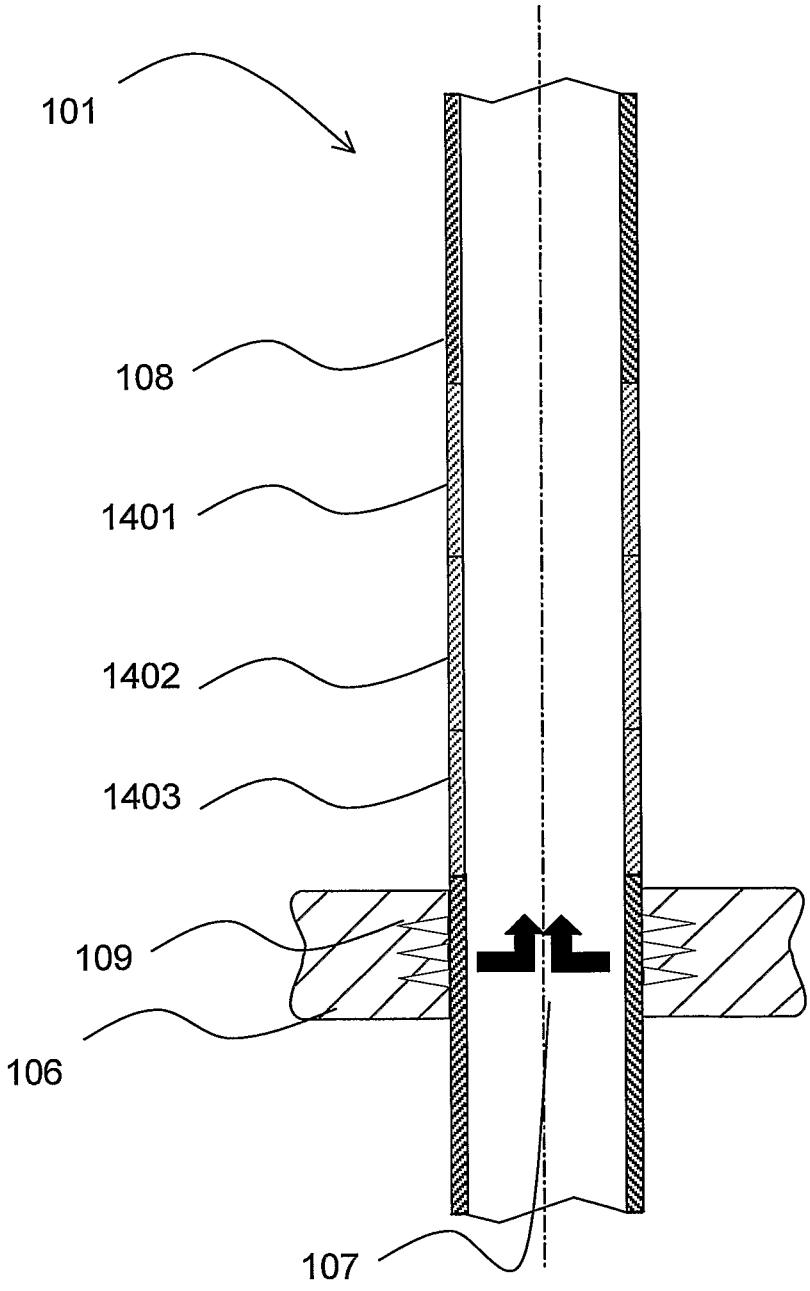
FIG. 14 shows an annular embodiment of the system of the invention.

An alternative embodiment of the present invention is shown in FIG. 14. FIG. 14 illustrates an example of a subterranean well 101 which embodies principles of the present invention. It is to be understood that the various embodiments of the present invention described herein may be utilized in various orientations, such as inclined, inverted, horizontal, vertical, etc., and in various configurations, without departing from the principles of the present invention.

The well 101 is described herein as being a producing well in which fluid is produced from a formation 106 into a tubular string 108, and is then flowed through this tubular string to surface. However, it is to be clearly understood that the principles of the present invention may be incorporated into other types of wells and other systems, for example, where fluid is injected into a formation or circulated in the well (such as drilling operations), where fluids pass from a relatively high pressure source to a relatively low pressure source within the well, or where fluid flows from a pump or other "artificial" pressure source etc. Thus, it is not necessary in keeping with the principles of the present invention for fluids to be produced through a tubular string or from a well.

In the well 101 as shown in FIG. 14, fluid from the formation 106 enters the tubular string 108 through a flow access 109, which may be, but is not limited to, perforations and/or a valve, and flows upwardly in the tubular string, as represented by the arrows 107.

Further, FIG. 14 illustrates an embodiment of the invention, where an annular type energy generator system 1401 is installed as part of the tubular string 108. In another embodiment of the invention, said annular type energy generator system 1401 can be installed in the well subsequent to the completion stage by means of intervention techniques as known per se. Fluid flow 107 through the tubular string 108 causes the annular type energy generator 1401 to generate electrical power. In this embodiment the annular type energy generator 1402 is installed in conjunction with a gauge 1403, and a annular type telemetry system 1402, which may be installed at any depth in well 101 as part of the tubular 108 or by means of a retrievable system such as a packer (as described in relation to FIG. 1). However, it is to be clearly understood that the gauge 1403 and the telemetry system 1402 is used merely as an example of the wide variety of downhole tools and other types of devices that may be powered by the annular type energy generator 1401, such as valves, flow control devices, communication devices, etc., and furthermore the annular type energy generator 1401 can be installed into a well utilizing other means than as part of the tubular string 108, which in this embodiment is included as an example. Other means may include components such as packers, straddle packers, wellbore hangers, etc.

The various devices, such as the gauge 1403 and the telemetry system 1402 can be electrically connected to the annular type energy generator 1401 via electric lines or conductors, integrally formed, or directly connected to each other. Furthermore, the annular type energy generation system 1401 can be placed in any configuration to other downhole devices such as for example the gauge 1403, and the telemetry system 1402. The configuration illustrated in FIG. 14 is merely to illustrate one possible application of the invention.

Figure 15:
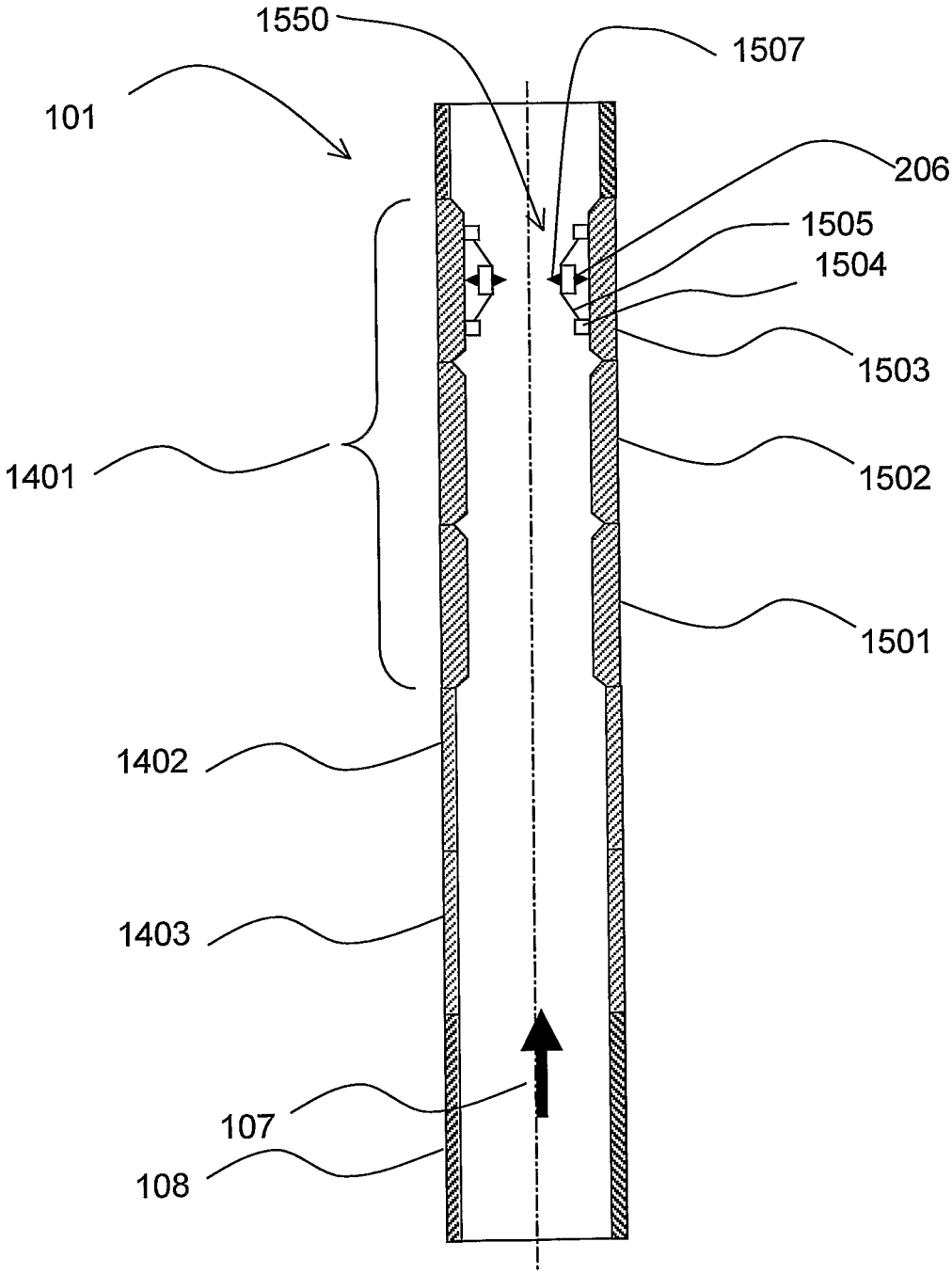
FIG. 15 shows further details of the annular embodiment shown in FIG. 14.

A preferred embodiment of the annular energy generator 1401 is illustrated in FIG. 15 where the annular type energy generator 1401 comprises an annular type energy storage 1501, an annular type electronics module 1502, an annular type energy harvester module 1503, and annular type vibrating assemblies 1550. Specifically, the vibrating assemblies 1550 comprise flexible tuning devices 1504, elongated arms 1505, and at least one crossbar 206 (two shown). The annular type energy generator 1401 may comprise several vibrating assemblies 1550. As described in relation to FIG. 2, each crossbar 206 is a vortex shedding device, which has a specific geometry required to maximize such vortex shedding as the fluid flow 107 impinges on the crossbar 206. In a preferred embodiment, the geometry may be based on results from detailed Computational Flow Dynamics (CFD) simulations utilizing various fluid parameters at various flow conditions and/or physical testing.

The fluid flow 107 may include one or more liquids (such as oil, water, gas condensate, etc.), one or more gases (such as natural gas, air, nitrogen, etc.), one or more solids (such as sand, scale deposits, cuttings related to drilling, artificial sands, etc.) or any combination of liquids and/or gases and/or solids.

Further to FIG. 15, as fluid flow 107 impinges on the crossbar 206, the crossbar sheds vortices as described earlier herein. As for the embodiments explained in FIG. 1-FIG. 13, vortex shedding may be prevented in undesired planes by adding a shield 207, typically to each short side of the crossbar(s) (as detailed in relation to FIGS. 2, 4, and 5).

Further to FIG. 15, the vibrating assemblies 1550 are built such that in situations where intervention tools are deployed through/past the annular type energy generator, the vibrating assemblies will be forced towards the inner wall of the annular type energy harvester module 1503, providing a maximum possible inner diameter (ID) through the system. In one embodiment, this is achieved by a flexible hinge system within the flexible tuning device 1504.

Figure 16:
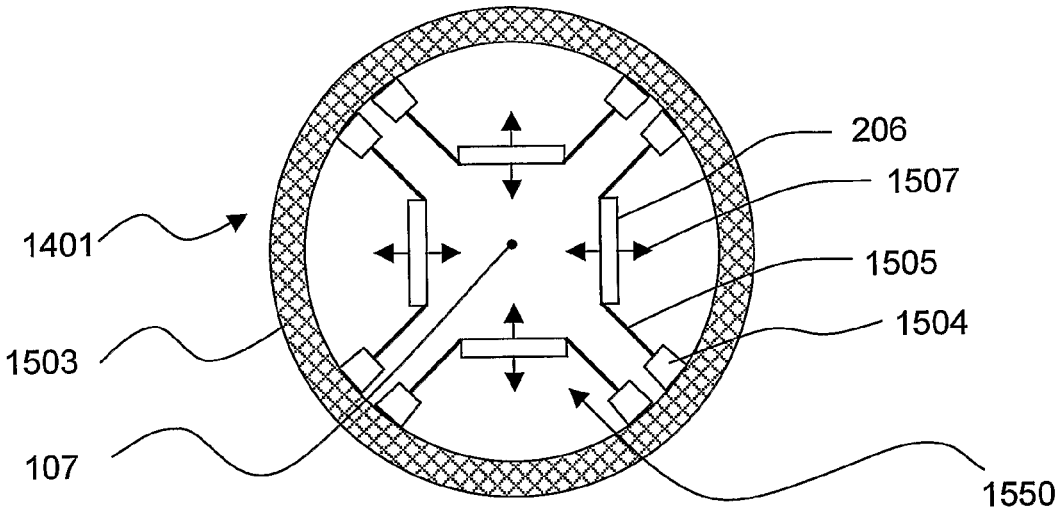
FIG. 16 shows even further details of the annular embodiment shown in FIG. 14.

FIG. 16 illustrates a top view of the annular type energy generator 1401 and illustrates one possible embodiment of the annular version of the present invention comprising four vibrating assemblies 1550 with appurtenant components. It is to be clearly understood that the present invention is not limited to this number of vibrating assemblies 1550. As fluid flow 107 (illustrated as a dot as the fluid flow 107 is towards the view in FIG. 16) impinges on the crossbars 206, the crossbars 206 sheds vortices in an asymmetric pattern, which in turn produces alternating lift forces on the crossbars 206 and elongated arms 1505, which in turn will force the arms 1505 and crossbars 206 to oscillate as indicated by arrows 1507.

The frequency of the oscillations 1507 of the arms 1505 and the crossbars 206 are controlled by factors as described earlier herein. Further, all components described for the other non-annular applications may be incorporated partly or fully in the annular application, too. For instance, flexible tuning devices 1504 may be included to tune the natural oscillating frequency of the mechanical system with respect to the frequency of the fluid imposed oscillations. In one embodiment, the flexible tuning devices 1504 can be adjusted autonomously during operation if flow and/or fluid parameters change.

Further to FIG. 15 and FIG. 16, in one embodiment of the present invention an energy harvester 1001 can be placed inside the crossbars 206, as explained in relation to FIG. 11, and in another embodiment energy harvesters 1001 can be placed in connection with the arms 1505 within the body of the annular type energy harvester module 1503 as explained in relation to FIG. 10, and in another embodiment energy harvesters 1001 can be placed fully or partly within a flexible tuning device 1504, or a combination and/or multiples of the above.

Figure 17:
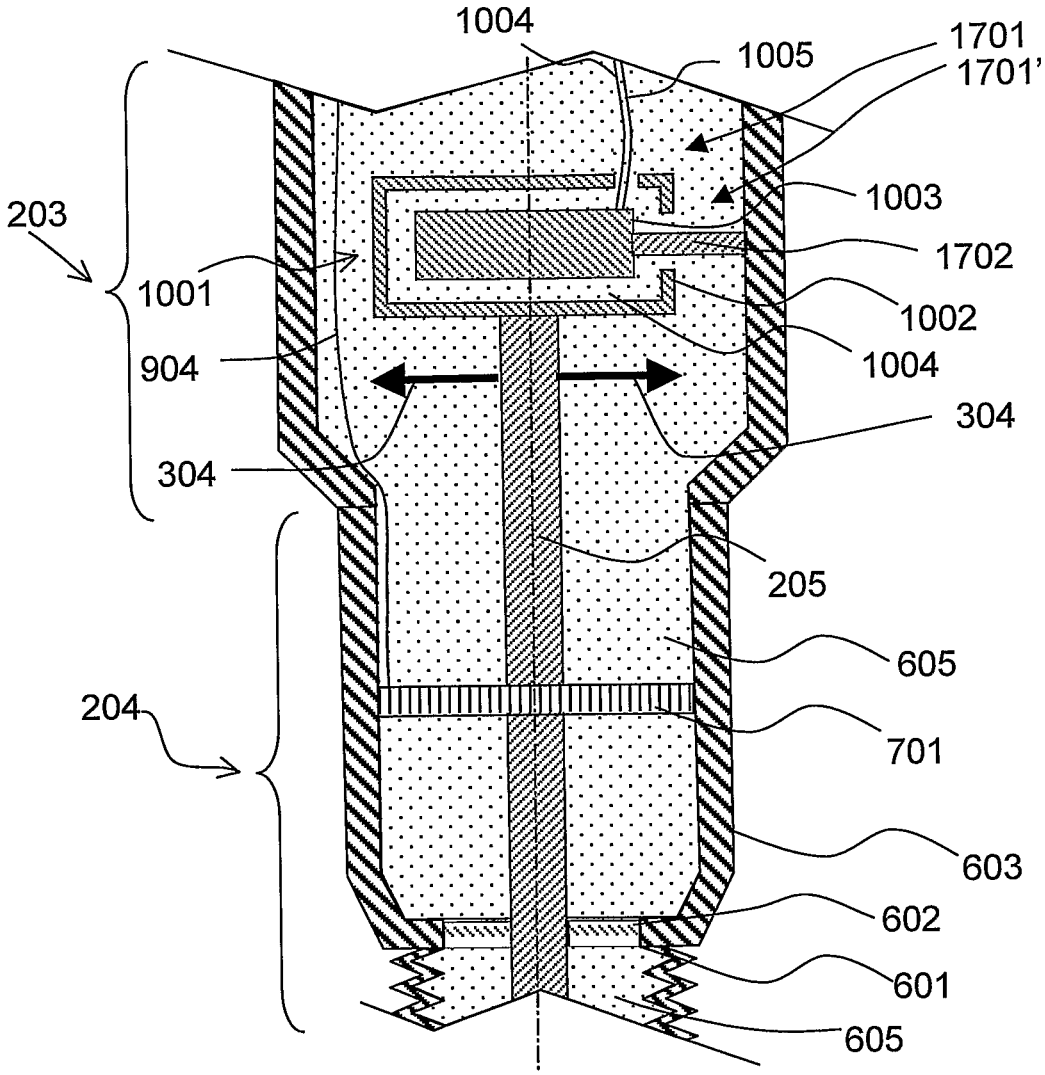
FIG. 17 shows yet another embodiment of the energy harvesting system and method.

FIG. 17 illustrates an alternative embodiment further to what is shown in FIGS. 10, 11 and 12. In the embodiment shown, the housing 1002 is perforated by means of two channels 1701, 1701'. Hence, the internal components (the electric energy generating part of the harvester 1001) are exposed to the same internal fluid 605, pressure and other parameters as are present inside the pressure housing 603. Further, in this embodiment, at least parts of the internal components 1003 is fixed to the housing 603, as illustrated here by beam 1702. As an example, a magnet/magnets could be attached to the arm 205 and a coil/coil assembly attached to the pressure housing 603 body. In a preferred embodiment of the invention, the coil element(s) is attached to the oscillating parts of the system, whereas the magnet element(s) is attached to a fixed, static part of the system such as the pressure housing 603 body. Further to a preferred embodiment, the amount, location and geometry of the channels 1701, 1701' entail an absolute minimum fluid imposed damping of the oscillation parts of the system (including housing 603) as a function of interaction with internal fluid 605. Preferably, the internal fluid 605 should be a gas rather than a liquid in order to further reduce said interaction, hence minimise fluid damping of the system so that an optimal amount of power can be produced by the system. However, due to the pressure compensation device 601, which preferably should be quite flexible in order not to dampen the fluid induced oscillations to an unacceptable degree, it is unrealistic to use a gas under atmospheric conditions, as this could cause a collapse of the system by means of deflating the pressure compensation device to a state of destruction when in the high-pressurised well regime. In a similar manner, it would be equivalent unrealistic to use a gas at well pressure conditions, as this could entail inflation of the pressure compensation device and thereby destruction of the energy generation tooling when said tooling is located in atmospheric surroundings prior to a well installation.

Figure 18:
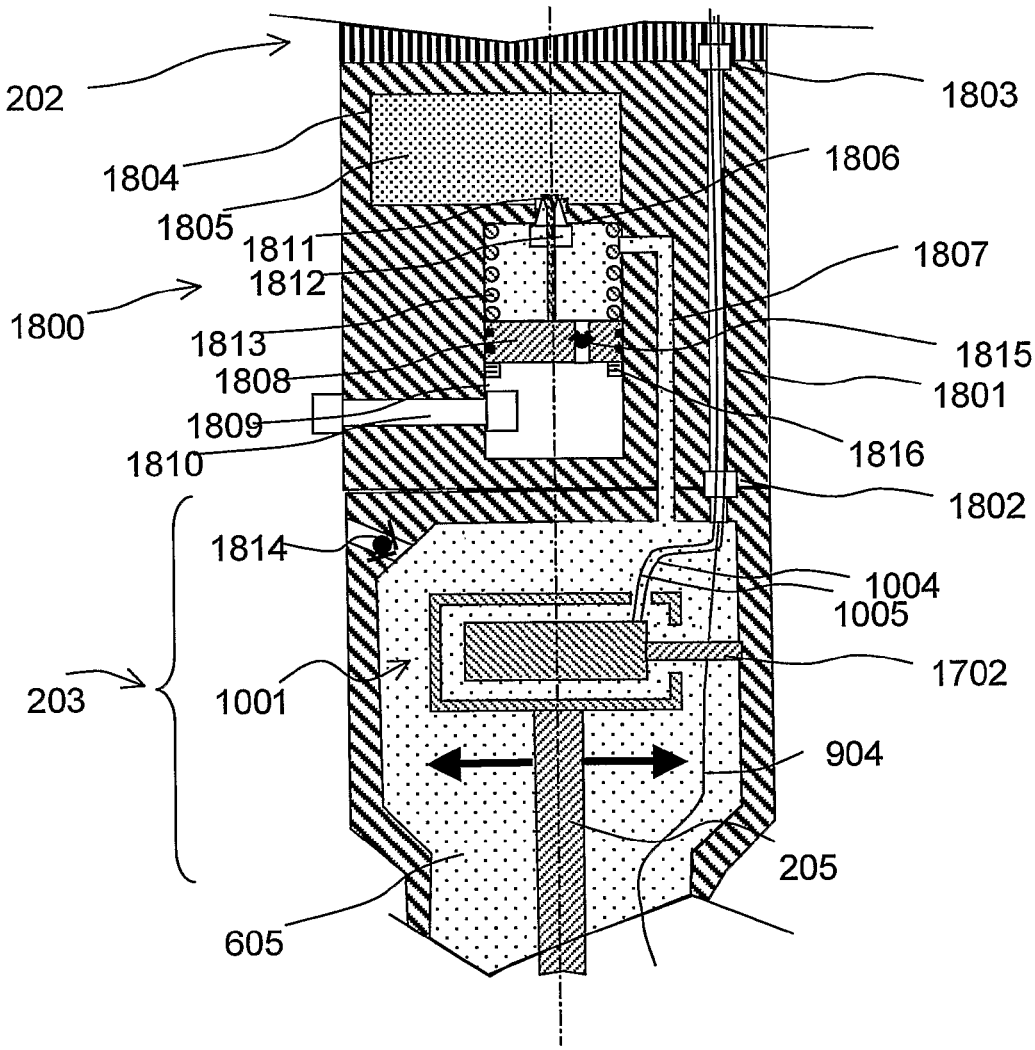
FIG. 18 shows an embodiment of the invention encompassing a gradual gas pressure compensation device.

To overcome the above described challenge, FIG. 18 illustrates a pressure equalising device 1800 that allows for a gradual increase of gas pressure of the internal fluid 605 of the energy harvester module 203 during intervention into and retrieval out of a well. In this embodiment, the pressure equalising module 1800 is located between the electronics module 202, and energy harvester module 203, however other configurations and locations could be chosen. In FIG. 18, wires 904, 1004 and 1005 are routed from the energy harvester module 203 to electronics module 202 via channel 1801 of the pressure compensation module 1800. In one embodiment, the channel 1801 also comprises pressure barriers such as indicated by barriers 1802 and 1803.

The pressure compensation module 1800 comprises a high-pressure chamber 1804. Typically, this chamber is purged with a high pressurised gas 1805 such as nitrogen prior to intervention and installation in the well. Further, pressure equalising device 1800 comprises a work chamber comprising an upper section 1806 and a lower section 1809 separated by a piston 1808. The upper section 1806 of the working chamber is in fluidic contact with the internal fluid 605 of the energy harvester 203 via the channel 1807. The lower section 1809 of the working chamber is in fluidic contact with the well fluid via the channel 1810. Do note that channel 1810 may include filters, fluid velocity reducers and other features to compensate for the fact that it will be exposed to well fluid that may carry impurities. The piston 1808 is connected to pilot valve 1811 via a shaft 1812. Further, the piston 1808 is being pushed/biased in the direction of the lower section 1809 of the working chamber by a spring 1813 towards end stop profile 1816. In a preferred embodiment of the invention, the spring force causes the pilot valve 1811 to be and remain in a shut position when pressure in the upper section 1806 of the working chamber equals the pressure of the tool surroundings (i.e. atmospheric conditions when at surface and well pressure surroundings when submerged in the well). Further, according to a preferred embodiment of the invention, the spring is compressed so that the pilot valve 1811 opens when a given overpressure exists in the lower section 1809 of the working chamber with respect to the upper section 1806. In one embodiment of the invention, a pressure differential in the range 1-20 psi is required to open the pilot valve 1811. When the pilot valve opens, compressed gas 1805 will flow from the high pressurised chamber 1804 into the upper section 1806 of the working chamber, and from there into the energy harvester module 203 via the channel 1807. This causes a pressure increase to take place in the upper section 1806 of the working chamber as well as in the internal fluid 605 of the energy harvester module 203. As said pressure increase causes the pressure differential between the upper section 1806 and the lower section 1809 of the working chamber to drop below a given set-value (as defined by means of a pre-adjusted spring force) the pilot valve 1811 will close. In a preferred embodiment of the invention, the described mechanisms will provide for a smooth, gradual gas pressure increase in the energy harvester module 203 as a function of submerging the tooling into a well.

In a preferred embodiment of the invention, the gradual pressure purging/equalising process as described herein will entail that the energy harvester 203 can be filled with a gas rather than a liquid, hence minimise liquid dampening impact on the energy generation process itself. Further to a preferred embodiment, the purging/equalising system will allow for the use of a very flexible pressure compensating device 601, allowing for optimised flexibility/freedom of the oscillating parts of the system. Further to a preferred embodiment of the invention, no significant damage or reduction in physical properties is imposed on the pressure compensation device 601 as a result of the functionality provided by the pressure equalising device 1800, meaning that the pressure compensation device 601 will be capable of handling any pressure differences created by the pressure equalising device 1800 during normal operation.

Further to a preferred embodiment of the invention, check valves 1814, 1815 are included in the system in order to allow for a safe retrieval of the tooling, i.e. bringing it from a high pressurised well condition to an atmospheric condition at the surface of the earth. In a preferred embodiment of the invention, said check valves are adjusted to open at a given overpressure. In one embodiment of the invention, said overpressure is in the range 1-30 psi. Further, said valves may have a function to avoid malfunction due to overpressure in the system should the pilot valve 1811 start to leak.

In another embodiment of the invention, said pilot valve 1811 and check valves 1814, 1815 could be replaced or supplemented with alternative valve designs, including such as solenoid valves and similar that could be operated by means such as logic functions steered by a micro controller based on appropriate sensor input, such as pressure sensor input.

In one embodiment of the invention, alternative pressure equalising devices 1800 can be utilised without departing from the idea of this invention.

Figure 19:
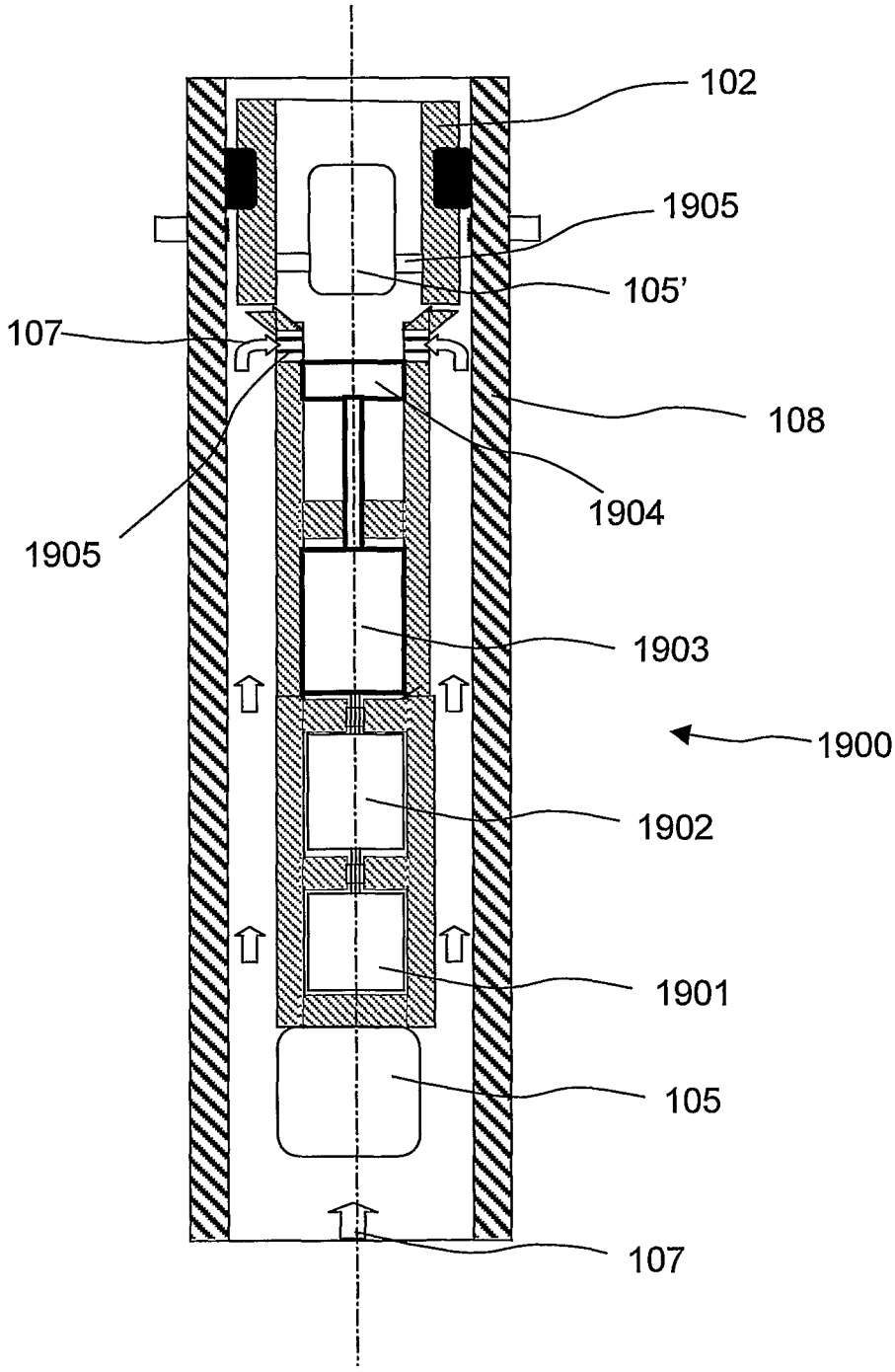
FIG. 19 shows alternative embodiments/locations of energy generation modules on an autonomous downhole device.

FIG. 19 illustrates an alternative embodiment of the invention, where an autonomous downhole tool 1900 is installed in the tubular string 108 of a well, in the proximity of the centre of the fluid flow 107. In the embodiment shown fluid flow 107 causes two energy generators 105, 105' (only the principle is illustrated) to generate electrical power.

As can also be seen from FIG. 19, the autonomous downhole device 1900 of this embodiment comprises a power storage section 1901, such as a rechargeable battery system or a capacitor bank system or a combination of both, possibly also in combination of non-rechargeable battery system elements. Further, the downhole device 1900 comprises a sensor and electronics module 1902. In one embodiment the sensor and electronics module 1902 comprises both sensoring elements as well as the majority of system electronics including system logic. An actuator module 1903 is used to move a piston 1904 inside a choke housing 1905 to control fluid flow 107 through the system. In one embodiment, the downhole device is used as a flow control device and/or barrier device, whereas in another embodiment of the invention the downhole device 1900 is used as a signalling device, transmitting wireless signals in the well by imposing pressure variations on the flowing fluid 107. In one embodiment of the invention, the downhole device 1900 represents a combination of functionalities, including the ability to provide for one- and/or two-way wireless communication. Furthermore, the autonomous downhole device 1900 can be placed in various configurations to other downhole devices such as for example the packer or plug system 102. The configuration illustrated in FIG. 19 is merely used to illustrate one possible application of the invention.

The invention shown in FIG. 19 is related to the location of the energy generator. In one embodiment of the invention, the energy generator is located in the bottom/upstream end of the autonomous downhole device 1900 as shown in figure element 105. In another embodiment of the invention, the energy generator is located inside or in the proximity of the choke module 1904, 1905, attached by shafts 1905, to harvest energy from vibrations in the present flow regime. In a preferred embodiment of the invention, the flow regime of the choke module 1904, 1905 is highly turbulent, so that any appropriate shape design of a vibrating element such as a crossbar 206 will provide for sufficient oscillations to generate acceptable energy levels, possibly to a greater extent than what is possible from an upstream location as shown with figure element 105.

Figure 20:
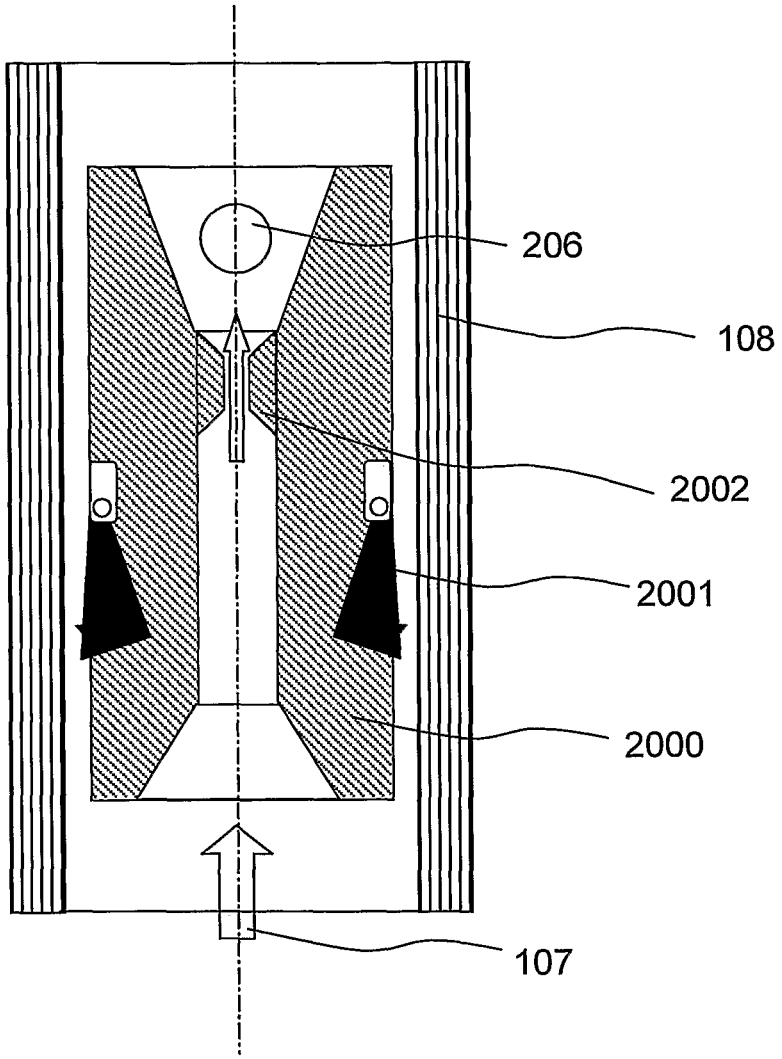
FIG. 20 shows an embodiment of the invention encompassing a flow alteration device.

FIG. 20 illustrates a possible supplement to a downhole energy generator based on principles as described herein. Here a bluff body system, which in one embodiment encompasses crossbar 206 designs as described herein, is illustrated by means of a circle, whereas remaining parts of energy generators or associated system modules as described earlier herein is not shown.

FIG. 20 illustrates one embodiment of a flow alteration device 2000 which has a function to adjust the flow in order to interact with the energy generator in an optimal manner with respect to energy generation. For this embodiment of the invention, the flow alteration device 2000 routes the well flow 107 through a restriction 2002 prior to impinging on the crossbar 206. By means, the flow velocity of the fluid hitting the crossbar 206 will be relatively high with respect to the fluid flow in the rest of the well, and larger amounts of energy may be generated. The flow alteration device may also be used to obtain an optimal Reynolds number for energy generation purposes, and in one embodiment the flow alteration device can be actively controlled and steered as part of the frequency tuning process as described earlier herein. Further to FIG. 20, the flow alteration device 2000 may be equipped with flow blockage elements 2001, such as hinged elements, compressible or inflatable elastic elements or any other mechanical element, actively steered elements or elements that create said flow blockage by means of passive/automatic operations. The intention with the flow blockage elements 2001 is to concentrate as much as the fluid flow 107 to the section where the crossbar 206 is located.

In one embodiment of the invention, the flow alteration device 2000 has the capability to create alterations in multiphase flow comprising a combination of at least two of the components oil, gas and water in order to obtain an optimal energy generation process. In one embodiment of the invention, said flow alteration device 2000 for multiphase flow include system elements to separate the fluid phases, such as to separate the gas phase from a fluid phase, so that energy can be harvested from one single phase fluid flow, or multiple single phase fluid flow streams, respectively. In one embodiment, said system elements to separate the fluid phases comprise active or passive systems for creating a centrifuge/cyclone effect on the multiphase fluid. In another embodiment, said system elements may comprise profiles that make the flow laminar and subsequently separates it by means of gravitational forces, or a combination of methods as described herein.

Figure 21:
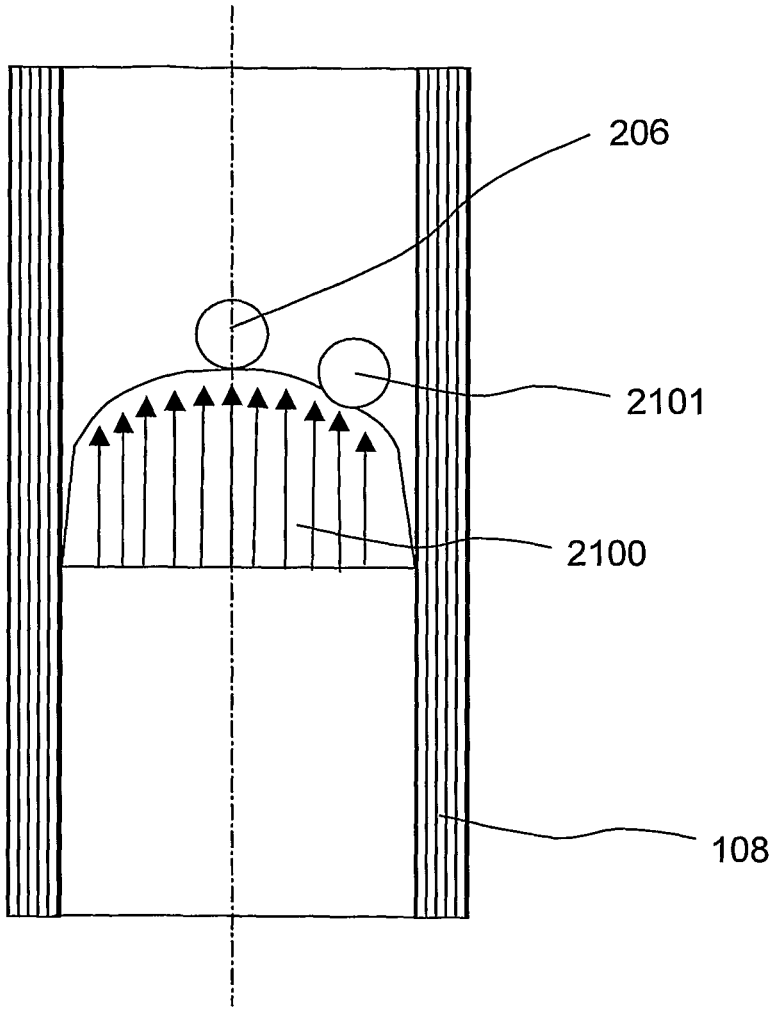
FIG. 21 shows possible locations of crossbars and/or vibration generation elements in the flow profile of a well.

FIG. 21 illustrates two possible locations of a bluff body assembly such as a crossbar 206 in a fluid flow. Typically, for developed monophase flow in pipe, a characteristic flow velocity profile 2100 develops. In a preferred embodiment of the invention, the downhole tooling that incorporates an energy generator possesses centralising elements and/or similar in order to locate the crossbar 206 close to the centre of the pipe 108 and velocity profile 2100, in order to achieve an optimal vortex shedding effect. In another embodiment, a different type crossbar 2101, designed for optimal interaction with the flow at a location where the velocity profile 2100 is asymmetric or chaotic across the crossbar 2101, is utilised for energy generation. In still another embodiment, combinations of crossbars 206 and 2101 are utilised for downhole energy generation.

Figure 22:
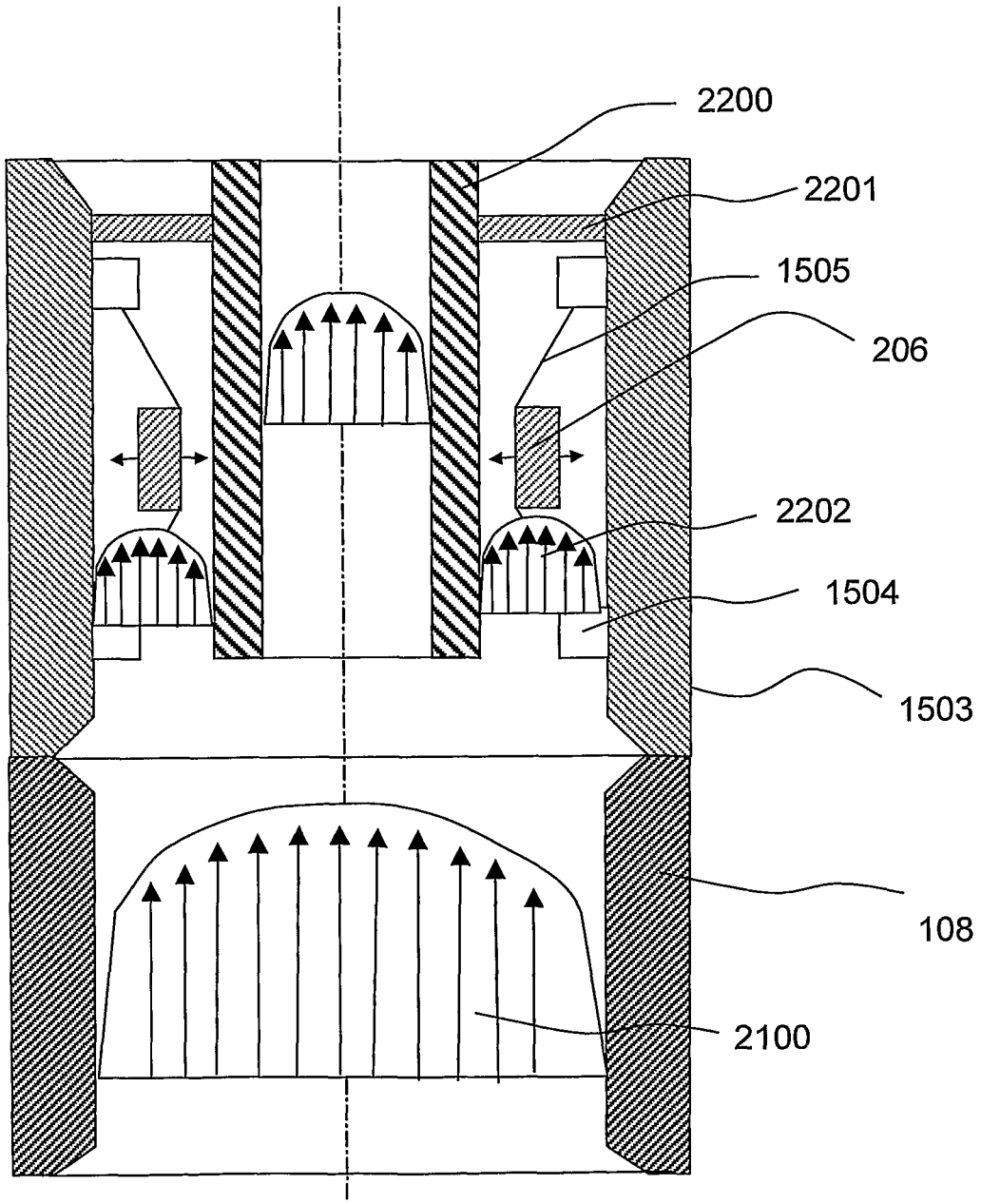
FIG. 22 shows an annular embodiment of the flow alteration device described in FIG. 20.

FIG. 22 shows an embodiment of the invention related to an annular design, further to descriptions provided in FIG. 15. Here, an annular flow alteration device 2200, attached to the main housing 1503 by means of beams 2201, creates annular flow velocity profiles 2202 that are symmetric across the crossbars 206 crossection perpendicular to the flow direction, to provide for an optimal vortex shedding, hence energy generation process as well as mechanical protection of the crossbars 206 from mechanical intervention tools as well as other mechanical impact that could occur to wellbore tooling. The flexible tuning device 1504 is illustrated for principle only.

What is claimed is:

1. A downhole electrical energy generating device for transforming energy from a fluid flow passing the device, the device comprising:

at least one vibrating assembly influenced by the fluid flow to oscillate, the vibrating assembly including an elongated body having a longitudinal axis arranged non-parallel with the fluid flow;

a stiff body connecting the elongated body to a portion of the device located downstream of said elongated body; and at least one energy harvester influenced by the vibrating assembly, wherein the energy generating device comprises a frequency influencing device positioned and configured to influence an oscillation frequency of the vibrating assembly, and wherein the stiff body extends into a sealed housing filled with a fluid.

2. The device according to claim 1, wherein the elongated body comprises at least one shield positioned and configured to suppress vortex shedding along a first direction of the elongated body, said first direction vortex shedding dampening desired vortex shedding along a second direction of the elongated body.

3. The device according to claim 1, wherein the frequency influencing device comprises a tuning device positioned and configured to alter one or more characteristics of the downhole electrical energy generation device.

4. The device according to claim 1, wherein the frequency influencing device comprises a tuning device that comprises at least one of:

a stiffness changer positioned and configured to change a stiffness of the vibrating assembly;

a mass changer positioned and configured to change a dominant oscillation mass of the vibrating assembly; and an output controller configured to control an electric output from a generator.

5. The device according to claim 1, wherein the frequency influencing device comprises an adjuster configured to adjust autonomously said frequency during operation.

6. The device according to claim 5, wherein the frequency influencing device comprises a tuning device that further comprises:

at least one sensor for sensing changes in energy levels of the vibrating assembly and/or energy produced by the harvester; and at least one actuator, controlled by a system controller, based on feedback from the sensor, to mechanically and/or electrically alter characteristics of the vibrating assembly.

7. The device according to claim 1, wherein the at least one energy harvester is arranged within said sealed housing.

8. The device according to claim 7, wherein the fluid is a gas.

9. The device according to claim 1, wherein the at least one energy harvester is arranged in a portion of the elongated body.

10. The device according to claim 1, wherein the energy generating device comprises a pressure equalizing device arranged for adapting the pressure of the fluid within the housing to the surrounding pressure of the device.

11. The device according to claim 1, further comprising a flexible attachment joint positioned within the sealed housing; and the stiff body is attached to the housing by the flexible attachment joint, the flexible attachment joint providing a pivot point for the stiff body.

12. A method for optimising energy harvesting from a fluid flowing in a pipe, the method comprising:

arranging a downhole electrical energy generating device in the fluid flow, said device comprising at least one vibrating assembly influenced by the fluid flow, and at least one energy harvester influenced by the vibrating assembly, the vibrating assembly including an elongated body and a stiff body connecting the elongated body to a portion of the device, and the stiff body extends into a sealed housing filled with a fluid, the device comprising a frequency influencing device positioned and configured to influence an oscillation frequency of the vibrating assembly; and setting the frequency influencing device to influence the oscillation frequency.

13. The method according to claim 12, wherein the method further comprises:

adopting a fluid pressure within a portion of the device to a surrounding pressure of the device using a pressure equalizing device.

14. The method according to claim 12, further comprising:

a flexible attachment joint positioned within the sealed housing; and the stiff body is attached to the housing by the flexible attachment joint provided, the flexible attachment joint providing a pivot point for the stiff body.

* * * * *